US009744981B2

(12) United States Patent
Niinomi et al.

(10) Patent No.: US 9,744,981 B2
(45) Date of Patent: Aug. 29, 2017

(54) OPERATION MANAGEMENT DEVICE, OPERATION MANAGEMENT METHOD, VEHICLE, VEHICULAR TRAFFIC SYSTEM, AND PROGRAM

(71) Applicant: MITSUBISHI HEAVY INDUSTRIES, LTD., Tokyo (JP)

(72) Inventors: Toshihiko Niinomi, Tokyo (JP); Kenji Takao, Tokyo (JP); Noritaka Yanai, Tokyo (JP); Yasuyuki Suzuki, Tokyo (JP); Yutaka Miyajima, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 49 days.

(21) Appl. No.: 14/761,519

(22) PCT Filed: Jan. 30, 2014

(86) PCT No.: PCT/JP2014/052130
§ 371 (c)(1),
(2) Date: Jul. 16, 2015

(87) PCT Pub. No.: WO2014/192329
PCT Pub. Date: Dec. 4, 2014

(65) Prior Publication Data

US 2015/0360706 A1 Dec. 17, 2015

(30) Foreign Application Priority Data

May 30, 2013 (JP) ..... 2013-114554

(51) Int. Cl.
*B61L 27/00* (2006.01)

(52) U.S. Cl.
CPC ..... *B61L 27/0016* (2013.01); *B61L 27/0027* (2013.01); *B61L 27/0077* (2013.01)

(58) Field of Classification Search
CPC ..... B61L 27/0027; B61L 27/0016; B61L 27/0077
See application file for complete search history.

(56) References Cited

U.S. PATENT DOCUMENTS

2011/0098908 A1* 4/2011 Chun ..... B61B 1/00 701/117

FOREIGN PATENT DOCUMENTS

JP H07-315222 A 12/1995
JP 2005-280637 A 10/2005
(Continued)

OTHER PUBLICATIONS

Japan Patent Office, "Notice of Allowance for Japanese Patent Application No. 2013-114554," Jun. 14, 2016.
(Continued)

*Primary Examiner* — Mussa A Shaawat
*Assistant Examiner* — Abdhesh Jha
(74) *Attorney, Agent, or Firm* — Manabu Kanesaka; Benjamin Hauptman; Kenneth Berner

(57) ABSTRACT

An operation management device that manages the operation of a plurality of vehicles is provided with: a vehicle position acquisition unit that acquires the positions of the plurality of vehicles; an interval adjustment unit that, on the basis of congestion information, identifies a station that is a reference for increasing the density of the plurality of vehicles that are present and sets a standby time at each station that is behind the station that is a reference, the standby time being for the plurality of vehicles that stops at the stations behind the station; and a departure determination unit that adjusts the departure times of the plurality of vehicles from each of the stations behind the station on the basis of the standby times.

8 Claims, 23 Drawing Sheets

(56) References Cited

FOREIGN PATENT DOCUMENTS

| | | | |
|---|---|---|---|
| JP | 2006-218996 | A | 8/2006 |
| JP | 2010-228688 | A | 10/2010 |
| JP | 2011-006009 | A | 1/2011 |
| JP | 2011-207303 | A | 10/2011 |
| JP | 2014-139052 | A | 7/2014 |

OTHER PUBLICATIONS

PCT/ISA/210, "International Search Report for International Application No. PCT/JP2014/052130," Apr. 28, 2014.
PCT/ISA/237, "Written Opinion of the International Searching Authority for International Application No. PCT/JP2014/052130," Apr. 28, 2014.

* cited by examiner

OPERATION MANAGEMENT DEVICE, OPERATION MANAGEMENT METHOD, VEHICLE, VEHICULAR TRAFFIC SYSTEM, AND PROGRAM

TECHNICAL FIELD

The present invention relates to a vehicle traveling along a track, an operation management device that manages an operation of a vehicle, a vehicular traffic system including the vehicle and the operation management device, an operation management method, and a program. Priority is claimed on Japanese Patent Application No. 2013-114554, filed May 30, 2013, the content of which is incorporated herein by reference.

BACKGROUND ART

In a conventional vehicular traffic system that provides a transportation service using vehicles (for example, a train) traveling along a predetermined track (line), the operation of each vehicle is managed on the basis of a predefined timetable. Specifically, the operation management device that is a so-called ground facility outputs an instruction to each vehicle based on an arrival time, a departure time, and the like determined for each vehicle, and the vehicle operates according to the instruction. In operation control based on such a timetable, the timetable is changed when the operation is disturbed, and the vehicles operate according to the changed timetable to achieve elimination of the service disruption. This timetable change is advanced work that requires securing of rationality, and effort and time are accordingly required. Further, the time is not only simply consumed, but also reasonably performing timetable changing work requires a lot of experience. Measures are limited according to the abundance of the experience. In particular, this trend is significant in cities in emerging countries where there is no railway.

Meanwhile, in recent years, with the significant development of information transfer means and the establishment of an information transfer method and facilities between an operation management system and a vehicle and between a vehicle and a vehicle, an environment in which a cooperation operation between the operation management system and the vehicle or a cooperation operation between the vehicles is possible can be built. Further, high performance of information processing means is significant, and the vehicle, the ground facility, and an individual device can perform independent information processing and control operation within a range of individual discretion.

For example, according to a train operation control method described in PTL 1, when a time delay of another vehicle is equal to or greater than a predetermined value, a departure time of the own vehicle is determined while a time interval between the other vehicle and the own vehicle is autonomously adjusted.

Meanwhile, when an occasional event such as a concert or an exhibition held in a specific stadium or exhibition hall is held, users may be centralized locally and temporarily in a specific station, such as a station closest to the event hall. In this case, if a vehicle operates according to a normal timetable, a situation in which it is difficult to cope with the temporarily increasing users (passengers) and it is difficult for the passengers to enter a platform of the station occurs, and confusion is caused. Accordingly, an operator of the vehicular traffic system obtains information for such an event in advance, and creates a special timetable on the basis of the number of users (number of passengers) of the station assumed from an estimated attendance of the event, a holding time and an end time of the event, a maximum number of passengers who can get on each vehicle, and path information. Specifically, this special timetable is created so that the specific station in which the concentration is expected and density of the presence of vehicles at that time become "dense". Thus, even when users are temporarily concentrated according to the occasional event, it is possible to provide a transportation service in which an operation interval is dense according to the increasing number of passengers.

CITATION LIST

Patent Literature

[PTL 1] Japanese Unexamined Patent Application Publication No. 2010-228688

SUMMARY OF INVENTION

Technical Problem

However, in coping using the special timetable as described above, it is necessary to spend time and effort for creation of special timetable. Further, when an unexpected situation, such as a case in which there has been a change in an end time of an event, has occurred, it is unlikely that the situation can be rapidly coped with.

Meanwhile, according to a train operation control method described in PTL 1, each of a plurality of vehicles adjusts vehicle spacing between the vehicle and a vehicle traveling in front or at the rear of the vehicle, and thus, an operation in which vehicle spacing is uniformized in the entire vehicular traffic system is obtained. However, the train operation control method described in PTL 1 is not a technology that enables adjustment for causing the vehicle spacing to be "dense" according to the number of passengers which locally increases at a specific station and on a specific time when the occasional event or the like as described above is held.

Further, according to the train operation control method described in PTL 1, a scheme of detecting the number (a degree of congestion) of passengers (waiting passengers) actually present at a station and correspondingly adjusting an inter-vehicle distance so that the number of passengers per vehicle is uniformized is used. However, the number of customers waiting at the station is in flux, and changes every moment. Accordingly, when the number of waiting passengers is detected at the present time and then adjustment of an operation interval starts, coping may be delayed and provision of a transportation service according to the number of waiting passengers may not be appropriately performed.

Further, when the vehicle performs an operation that is not based on a timetable, information indicating an arrival platform, an arrival vehicle, and an arrival time is not displayed on the display screen of the station.

The present invention provides an operation management device, an operation management method, a vehicle, a vehicular traffic system, and a program capable of solving the above-described problems.

Solution to Problem

According to a first aspect of the present invention, an operation management device is an operation management device that manages an operation of a plurality of vehicles traveling along a track, and includes a vehicle position acquisition unit that acquires positions of the plurality of vehicles present on the track; a spacing adjustment unit that specifies a station that is a reference for increasing density of the presence of the plurality of vehicles on the basis of predetermined congestion information, and sets a waiting time at each station at the rear of the reference station, of the plurality of vehicles that stop at the station at the rear; and a departure determination unit that adjusts a departure time at each station at the rear, of the plurality of vehicles on the basis of the waiting time.

According to a second aspect of the present invention, in the operation management device of the above-described aspect, the spacing adjustment unit sets the waiting time of a station closer to the reference station to be longer.

According to a third aspect of the present invention, in the operation management device of the above-described aspect, the spacing adjustment unit sets the waiting time on the basis of the number of passengers which is estimated at the reference station.

According to a fourth aspect of the present invention, in the operation management device of the above-described aspect, the spacing adjustment unit sets the waiting time so that a congestion occurrence time estimated on the basis of the congestion information matches a time at which density of the presence of the vehicles increases.

According to a fifth aspect of the present invention, in the operation management device of the above-described aspect, the spacing adjustment unit acquires, as the congestion information, one or more of prior passenger attracting information for a scheduled passenger attracting event, detection information acquired from detection means installed in a passage from a passenger attracting place to a station and detecting the number and a flow of passengers who use the passage, and information indicating a scheduled arrival time and a scheduled number of arrival passengers regarding another traffic network.

According to a sixth aspect of the present invention, a vehicular traffic system includes the operation management device of the above-described aspect; and a passenger information system that receives identification information, position information, and path information of a predetermined target vehicle from the operation management device, calculates a scheduled arrival time for each station of the target vehicle, and displays the calculated scheduled arrival time on a display screen installed in each station.

According to a seventh aspect of the present invention, a vehicle is a vehicle that travels along a track and includes a vehicle position acquisition unit that acquires a position of the own vehicle on the track; a spacing adjustment unit that specifies a station that is a reference for increasing density of the presence of a plurality of vehicles traveling on the track on the basis of predetermined congestion information, and sets a waiting time at each station at the rear of the reference station, of the own vehicle that stops at the station at the rear of the reference station; and a departure determination unit that adjusts a departure time at each station at the rear, of the own vehicle on the basis of the waiting time.

According to an eighth aspect of the present invention, an operation management method is an operation management method for managing an operation of a plurality of vehicles traveling along a track, and includes steps of: acquiring positions of the plurality of vehicles present on the track; specifying a station that is a reference for increasing density of the presence of the plurality of vehicles on the basis of predetermined congestion information, and setting a waiting time at each station at the rear of the reference station, of the plurality of vehicles that stop at the station at the rear; and adjusting a departure time at each station at the rear, of the plurality of vehicles on the basis of the waiting time.

According to a ninth aspect of the present invention, a program causes a computer of an operation management device that manages an operation of a plurality of vehicles traveling along a track to function as: vehicle position acquisition means for acquiring positions of the plurality of vehicles present on the track; spacing adjustment means for specifying a station that is a reference for increasing density of the presence of the plurality of vehicles on the basis of predetermined congestion information, and setting a waiting time at each station at the rear of the reference station, of the plurality of vehicles that stop at the station at the rear; and departure determination means for adjusting a departure time at each station at the rear, of the plurality of vehicles on the basis of the waiting time.

Advantageous Effects of Invention

According to the operation management device, the operation management method, the vehicle, the vehicular traffic system, and the program described above, density of provision of a transportation service using the vehicles can be flexibly changed at a desired time and at a desired station.

DESCRIPTION OF EMBODIMENTS

First Embodiment

Hereinafter, a vehicular traffic system according to a first embodiment of the present invention will be described with reference to the drawings.

Figure 1:
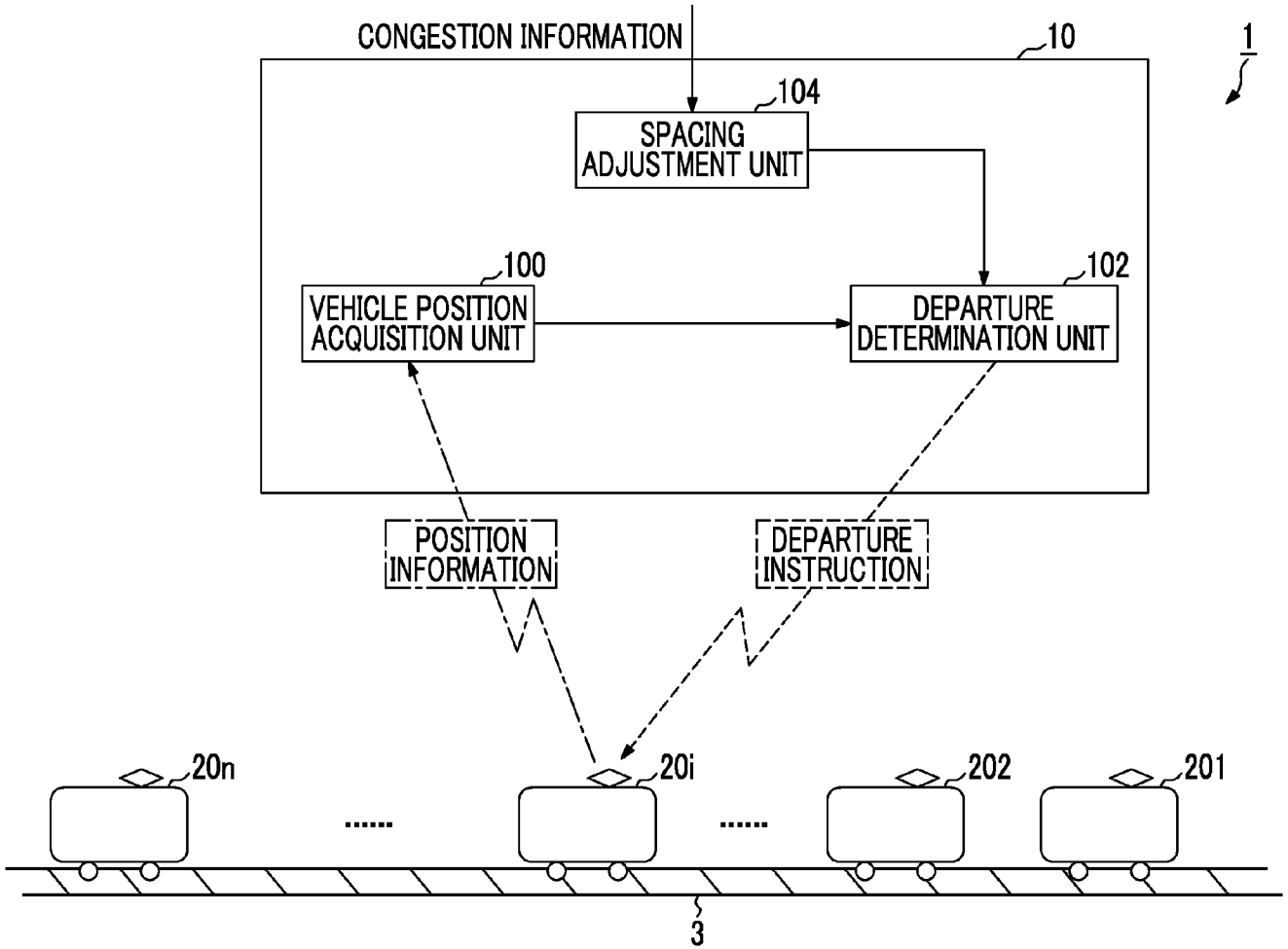
FIG. 1 is a diagram illustrating a functional configuration of a vehicular traffic system according to a first embodiment of the present invention.

FIG. 1 is a diagram illustrating a functional configuration of a vehicular traffic system according to a first embodiment of the present invention. In FIG. 1, reference sign 1 indicates a vehicular traffic system.

(Configuration of Entire Vehicular Traffic System)

First, an entire configuration of the vehicular traffic system 1 will be described.

As illustrated in FIG. 1, a vehicular traffic system 1 according to the present embodiment includes an operation management device 10, and a plurality of vehicles 201, 202, . . . , 20*n* (n is an integer equal to or greater than 2) that travel along a track 3. The operation management device 10 is called a ground facility, and is a device for controlling an operation of the plurality of vehicles 201, 202, . . . , and 20*n*.

The operation management device 10 according to the present embodiment is a functional unit that transmits a departure instruction to each of the vehicles 201, 202, . . . , 20*n* on the basis of a determination of the departure determination unit 102 to be described below. The operation management device 10 transmits the departure instruction to each of the vehicles 201 to 20*n* using wireless communication means or the like. Each of the vehicles 201 to 20*n* operates on the basis of the departure instruction received from the operation management device 10.

Further, in an actual operation of the vehicle, operation control based on a security device (interlocking device) or a signal is further added. However, a case in which the operation control of the vehicles 201 to 20*n* is simply performed on the basis of the operation management device 10 will be described for simplification of the description of the present embodiment (a case in which the security device or the like is used will be described below with reference to FIG. 19.)

The vehicles 201, 202, . . . , 20*n* constitute a train that travels along the predetermined track 3 (line). The vehicles 201 to 20*n* travel while arriving at and departing from a plurality of stations (not illustrated in FIG. 1) provided along the track 3 according to an operation instruction received from the operation management device 10. Further, predetermined position detection devices (not illustrated) are provided at regular intervals in the track 3, and each of the vehicles 201 to 20*n* communicates with the position detection device, and thus, can recognize a position on the track 3 in which the own vehicle travels.

This function will be described in greater detail. Each of the vehicles 201 to 20*n* includes its own line database. Also, each of the vehicles 201 to 20*n* has a function of measuring the number of tire rotations of the own vehicle to calculate a travel distance and recognizing a current position of the own vehicle. However, in this case, the current position recognized from the number of tire rotations may deviate from an actual position due to tire slip. Each of the vehicles 201 to 20*n* corrects the deviation through a comparison with a position detection device placed on the ground, and accurately recognizes a position on the track 3 in which the own vehicle is traveling.

Here, in the case of a normal vehicular traffic system, the timetable is determined so that a supply and demand balance is optimized, on the basis of the number of users (the number of passengers) and a possible riding amount of each vehicle. In general, when there are two timetables including a weekday timetable and a holiday timetable, any problems are not caused in provision of a daily transportation service. However, for example, if a special event such as a concert or an exhibition is held at any event site, an increase in the number of passengers only at that day may be specifically expected. In such a case, the operation based on a daily timetable causes a problem in that passengers cannot be transported. Accordingly, the vehicular traffic system 1 according to the present embodiment is a function of acquiring information ("congestion information" to be described below) estimated from, for example, content of the event, and intentionally creating a state in which vehicle spacing at a specific station is "dense" for suitability for situation of the congestion in advance.

(Configuration of Operation Management Device)

Next, a configuration of the operation management device 10 will be described.

As illustrated in FIG. 1, the operation management device 10 according to the present embodiment includes a vehicle position acquisition unit 100, a spacing adjustment unit 104, and a departure determination unit 102.

The vehicle position acquisition unit 100 is a functional unit that acquires positions of a plurality of vehicles 201 to 20*n* present on a track 3. Each of the vehicles 201 to 20*n* can communicate with a position detection device (not illustrated) provided on the track 3 to recognize a position on the track 3 in which the own vehicle is traveling, as described above. Also, the respective vehicles 201 to 20*n* sequentially transmit "position information" indicating a travel position of the own vehicle to the operation management device 10 through wireless communication. The vehicle position acquisition unit 100 of the operation management device 10 receives the position information of the respective vehicles 201 to 20*n* to acquire the positions of the vehicles 201 to 20*n*. Further, the vehicle position acquisition unit 100 may acquire not only the position information of each vehicle, but also information indicating the maximum number of passengers who can get on each vehicle. Further, in another embodiment, each of the vehicles 201 to 20*n* may transmit the position information to the operation management device 10 through wired communication.

The spacing adjustment unit 104 specifies a reference station at which the density of the presence of the plurality of vehicles 201 to 20*n* is high (destination station Hm (m is an integer equal to or greater than 2)) on the basis of the "congestion information" acquired from a predetermined information source, and sets the waiting time ωj at each station Hj at the rear of the destination station Hm (j is an integer equal to or greater than 1 and less than m), of the plurality of vehicles 201 to 20*n* that stop at the station Hj. Here, the "congestion information" is, specifically, information such as position requirements (for example, a nearest station) of an event site where an event (for example, a concert or an exhibition) or the like is held, the number of attending passengers estimated in advance, a start time of the event, and an end time thereof. That is, the congestion information is information from which occurrence of the congestion can be expected in a step before the congestion actually occurs in a station. A specific method of acquiring the congestion information will be described below.

Further, the spacing adjustment unit 104 may further set the waiting time ωj on the basis of the maximum number of passengers who can get on the currently traveling vehicle, and the path information.

The spacing adjustment unit 104 according to the present embodiment first specifies the destination station Hm on the basis of the congestion information. The destination station Hm is a station at which the congestion is predicted, that is, a nearest station of the event site. Also, the spacing adjustment unit 104 performs a process of increasing the density of the presence of the vehicles 201 to 20*n* in front of the destination station Hm. Further, "the density of the presence of the vehicles 201 to 20*n*" is the number of the vehicles 201 to 20*n* within a certain range of the track 3. That is, the spacing adjustment unit 104 increases the number of vehicles 201 to 20*n* within a certain range in front of the destination station Hm (increases the presence density), and thus, the vehicular traffic system 1 can cope with passengers that locally temporarily increase at the destination station Hm.

The spacing adjustment unit 104 performs the following process in order to increase the density of the presence of the vehicles 201 to 20*n*. The spacing adjustment unit 104 sets the waiting time ωj for each station Hj at the rear of the destination station Hm, of the plurality of vehicles 201 to 20*n* which stop at the station Hj at the rear of the destination station Hm. A specific method of setting the waiting time ωj will be described below. Further, "the station Hj at the rear of the destination station Hm" indicates each station at which the vehicles 201 to 20*n* stop before the vehicles 201 to 20*n* stop the destination station Hm. Here, when the vehicles 201 to 20*n* are assumed to stop at the stations in an order of the stations H1, H2, . . . , Hm-1, and Hm, the station Hj at the rear of the destination station Hm includes stations H1, H2, . . . , Hm-1.

The departure determination unit 102 is a functional unit that adjusts the departure time at each station Hj at the rear of the plurality of vehicles 201 to 20*n* on the basis of the waiting time Tj set for each station Hj. Specifically, when the target vehicle 20*i* stops at the station Hj, the departure determination unit 102 performs a process of waiting for the waiting time Tj set for the station Hj, and transmits an instruction to instruct the target vehicle 20*i* to depart from the station Hj when the waiting time Tj has elapsed.

Further, the spacing adjustment unit 104 of the operation management device 10 according to the present embodiment has been described as acquiring the congestion information from the predetermined information source. As described above, the predetermined information source is, for example, a host of a passenger attracting event, and the congestion information is passenger prior passenger attracting information (for example, an event schedule or the expected number of passengers) for the passenger attracting event sent from the host in advance.

Further, the congestion information may be detection information that is acquired from detection means that is installed in a passage from a passenger attracting place in a facility such as a stadium to a nearest station (referred to as a buffer zone) and detects the number and flow of passengers who use the passage (for example, a video projected from a monitoring camera). A manager of the vehicular traffic system 1 monitors the monitoring camera that is a congestion degree prediction unit 5, and thus, can predict a time until congestion occurs in the nearest station (destination station H10) in advance. Further, the information may be, for example, detection information acquired from a passage detection sensor provided at a predetermined position (for example, a gate) of the passage, rather than the video from the monitoring camera.

Further, when the vehicular traffic system 1 communicates with another traffic network, the congestion information may be information indicating a scheduled arrival time and a scheduled number of arrival passengers of a transport medium regarding the other traffic network. For example, when the vehicular traffic system 1 is a transportation system that connects an airport terminal, demand for the vehicular traffic system 1 increases or decreases according to an aircraft take-off and landing schedule. Accordingly, in this case, the predetermined information source is an aircraft operating company, and the congestion information is the take-off and landing schedule or the number of passengers (boarding rate) of the aircraft.

(Function of Spacing Adjustment Unit)

Figure 2:
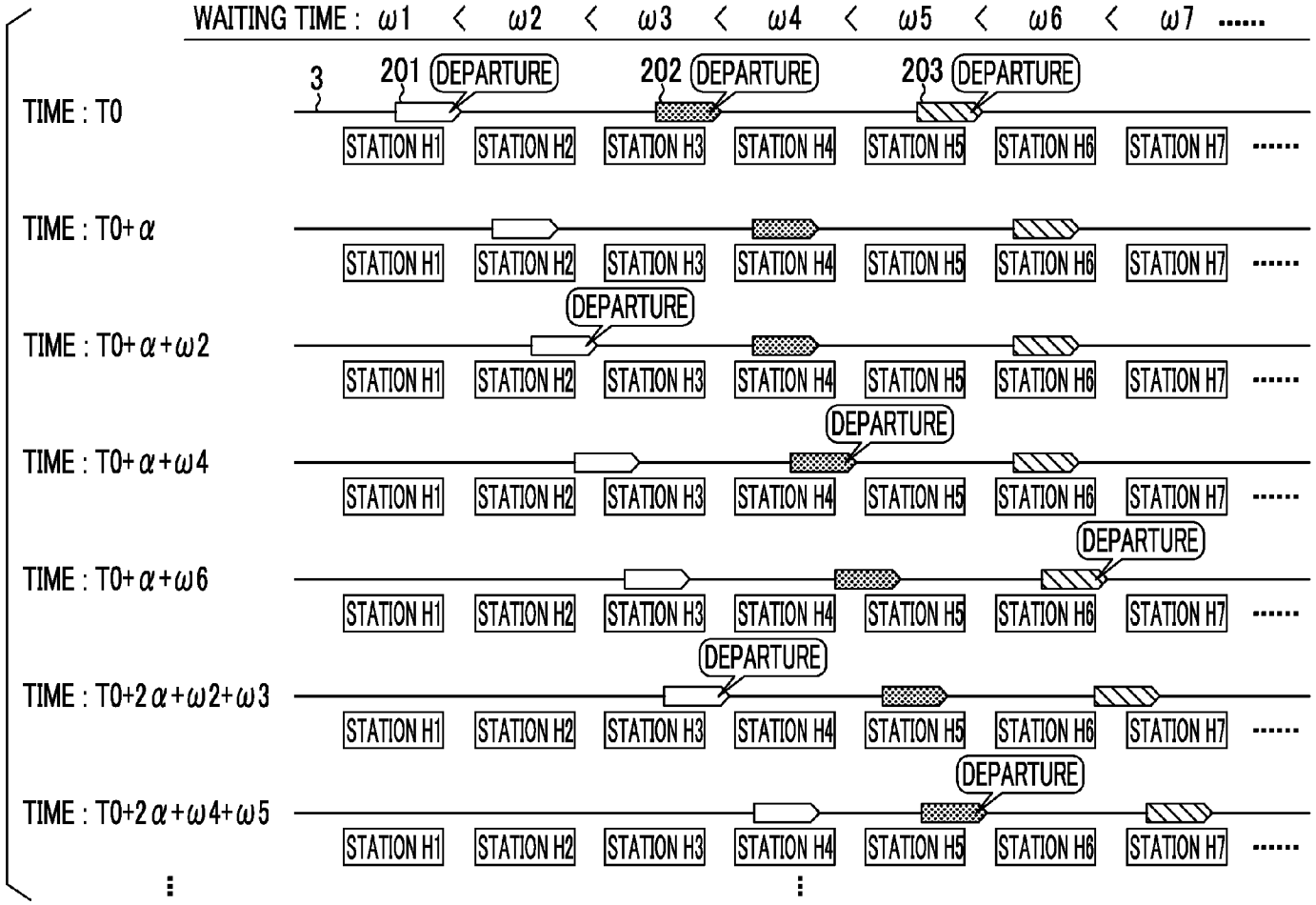
FIG. 2 is a first diagram illustrating functions of a spacing adjustment unit according to the first embodiment of the present invention.

FIG. 2 is a first diagram illustrating a function of the spacing adjustment unit according to the first embodiment of the present invention. The vehicles 201 to 203 illustrated in FIG. 2 are vehicles that operate along the track 3 while stopping at the stations in an order of the stations H1, H2, . . . , H7 from the left of a paper surface to the right. Further, each of the vehicles 201 to 20*n* also stops at stations (not illustrated in FIG. 2; stations H8, H9, H10, . . . ) subsequent to the station H7. Further, it is assumed for convenience of description that the stations H1 to H10 are all installed at equal intervals, and the vehicles 201 to 203 travel at equal speed between the stations. Further, in the following description, for simplification of the description, a time from departure from one station of each of the vehicles 201 to 203 to stop at the next station is assumed to be "α".

Hereinafter, a specific function of the spacing adjustment unit 104 will be described with reference to FIG. 2.

When the spacing adjustment unit 104 specifies a target station (for example, the station H10 (not illustrated in FIG. 2)) on the basis of predetermined congestion information, the spacing adjustment unit 104 sets the waiting times ω1 to ω9 at the stations H1 to H9 that are stations at the rear of the destination station H10 at a predetermined timing. Here, the spacing adjustment unit 104 sets the waiting time of the station closer to a reference station (destination station H10) to be longer. More specifically, the spacing adjustment unit 104 sets $\omega 1<\omega 2<\omega 3< \ldots <\omega 9$. However, the spacing adjustment unit 104 sets the minimum waiting time $\omega 1$ not to be below a minimum time Tmin that enables passengers to safely get on or off.

When the spacing adjustment unit 104 sets the waiting times $\omega 1$ to $\omega 9$ at the respective stations H1 to H9, the departure determination unit 102 adjusts the departure time at the respective stations H1 to H9 for all the vehicles 201, 202, and 203 traveling the section thereof based on the waiting times $\omega 1$ to $\omega 9$. Hereinafter, an operation process of the vehicles 201 to 203 on the basis of the waiting times $\omega 1$ to $\omega 9$ set by the spacing adjustment unit 104 will be described with reference to FIG. 2.

First, it is assumed that the vehicle 201 departs from the station H1, the vehicle 202 departs from the station H3, and the vehicle 203 departs from the station H5 at the same time (time: T0). Then, the vehicle 201 stops at the station H2, the vehicle 202 stops at the station H4, and the vehicle 203 stops at the station H6 (time: $T0+\alpha$). Then, the vehicle 201 waits for the waiting time $\omega 2$ at the station H2, and then departs from the station H2 (time: $T0+\alpha+\omega 2$). With a delay, the vehicle 202 waits for the waiting time $\omega 4$ ($>\omega 2$) at the station H4, and then, departs from the station H4 (time: $T0+\alpha+\omega 4$). Further, with a delay, the vehicle 203 waits for the waiting time $\omega 6$ ($>\omega 4$) at the station H6, and then, departs from the station H6 (time: $T0+\alpha+\omega 6$). As the waiting times at the respective stations have been set to be $\omega 2<\omega 4<\omega 6$, vehicle spacing of the vehicles 201 to 203 becomes narrower at this point.

Subsequently, the vehicle 201 waits for the waiting time $\omega 3$ at the station H3, and then, departs from the station H3 (time: $T0+2\alpha+\omega 2+\omega 3$). Then, the vehicle 202 waits for the waiting time $\omega 5$ ($>\omega 3$) at the station H5, and then, departs from the station H5 (time: $T0+2\alpha+\omega 4+\omega 5$). At this point, vehicle spacing between the vehicle 201 and the vehicle 202 is further narrowed. Further, the vehicle 203 does not depart from the station H7, and vehicle spacing between the vehicle 202 and the vehicle 203 is also narrowed. Thus, the spacing adjustment unit 104 sets the waiting times $\omega 1$ to $\omega 9$ at the stations H1 to H9, and accordingly, the vehicle spacing of the vehicles 201 to 203 are gradually narrowed as the vehicles 201 to 203 operate.

Figure 3:
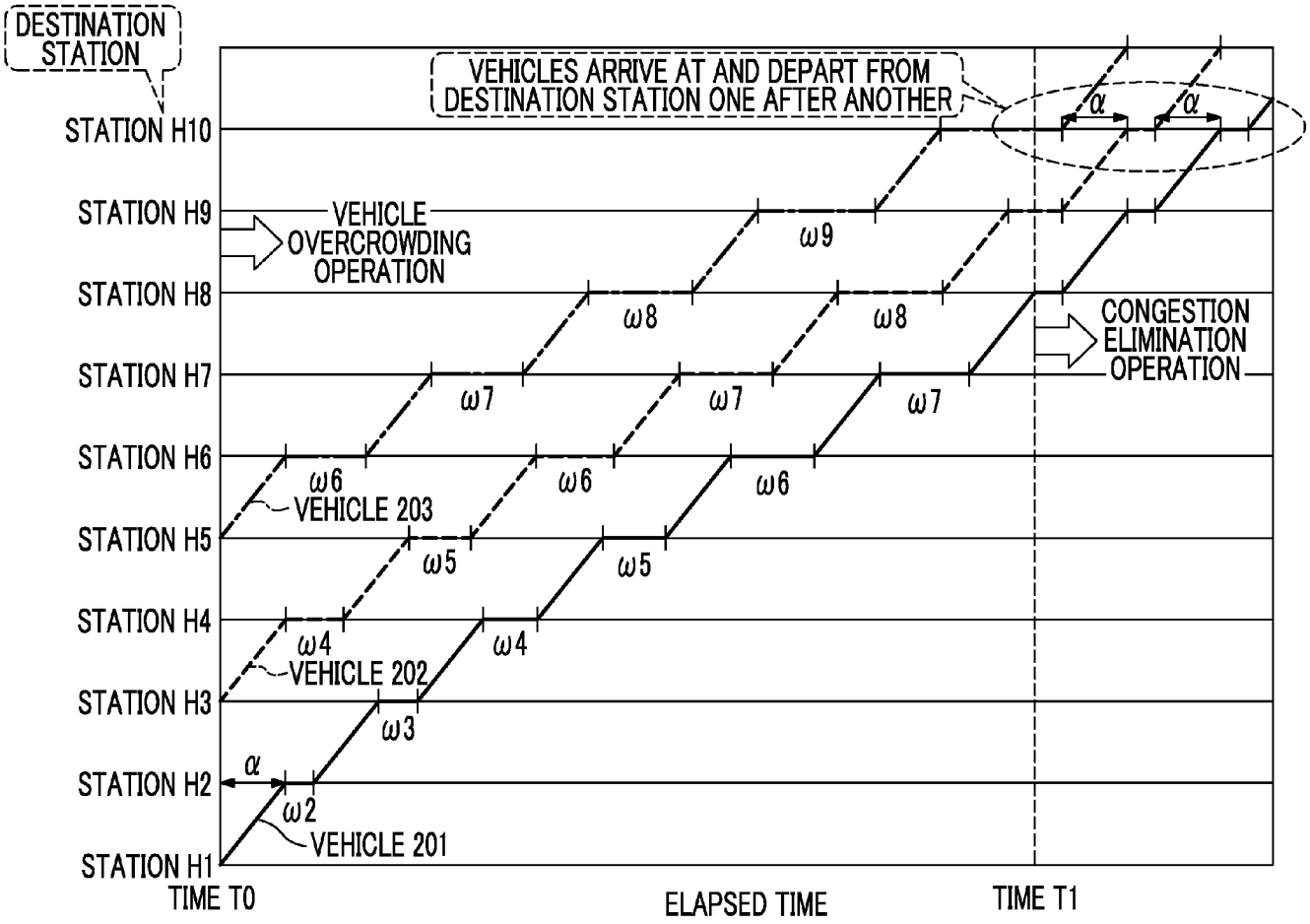
FIG. 3 is a second diagram illustrating functions of a spacing adjustment unit according to the first embodiment of the present invention.

FIG. 3 is a second diagram illustrating a function of the spacing adjustment unit according to the first embodiment of the present invention. In graphs illustrated in FIG. 3, a horizontal axis indicates an elapsed time from time T0, and a vertical axis indicates a position (a station and between stations) in which each of the vehicles 201 to 203 is present. As illustrated in FIG. 3, for example, the vehicle 201 departs from the station H1, the vehicle 202 departs from the station H3, and the vehicle 203 departs from the station H5 at time T0, and the respective vehicles arrive at the next station at time $T0+\alpha$.

As illustrated in FIG. 3, the vehicle 201 travels while waiting for the waiting times $\omega 2$ to $\omega 7$ set for the respective stations H2 to H7 at the stations H2 to H7. The vehicles 202 and 203 similarly travel while waiting for the waiting time set for the respective stations (vehicle overcrowding operation). As a result of this vehicle overcrowding operation, an inter-vehicle distance of each of the vehicles 201, 202, and 203 is gradually narrowed from time T0 to time T1. Also, a state in which the vehicles 203, 202, and 201 are dense at the destination station H10 and the stations H9 and H8 at the rear of the destination station (a vehicle overcrowding state) is completed at time T1, as illustrated in FIG. 3.

When the vehicle overcrowding state is completed, the operation management device 10 switches the operation of each of the vehicles 201 to 203 from the vehicle overcrowding operation to a congestion elimination operation. Specifically, the vehicles 201 to 203 operate to arrive at and depart from the destination station H10 at a minimum time interval (FIG. 3). Thus, at the destination station H10 at which the number of passengers increases, the vehicles 201 to 203 arrive and depart one after another, and thus, it is possible to resolve the congestion at the destination station H10.

Further, the spacing adjustment unit 104 appropriately sets the values of the vehicle overcrowding operation start time (time T0) and each waiting time $\omega j$ on the basis of the congestion information obtained in advance, as follows.

The spacing adjustment unit 104 sets the waiting time $\omega j$ so that the congestion occurrence time estimated on the basis of the congestion information and a time at which the density of the presence of the vehicles 201 to 20*n* increases match. This will be described in detail with reference to FIG. 3. The spacing adjustment unit 104 detects that the destination station H10 is congested at time T1 in advance based on the congestion information obtained in advance (the spacing adjustment unit 104 estimates the congestion occurrence time to be time T1). Therefore, the spacing adjustment unit 104 sets the start time T0 of the vehicle overcrowding operation and the respective waiting times $\omega 0$ to $\omega 9$ through inverse calculation so that the vehicle overcrowding state is completed at the destination station H10 at time T1 at which congestion is estimated to occur. Thus, the vehicle overcrowding state can be formed in advance according to the time at which the congestion has been estimated in advance (congestion occurrence time) T1, and thus, it is possible to rapidly cope with a sudden increase in passengers.

Further, when the spacing adjustment unit 104 determines that there is a time margin until the time T1 at which the congestion is expected based on, for example, the congestion information obtained in advance, the spacing adjustment unit 104 sets a period of time from time T0 to time T1 to be long, and sets the respective waiting times $\omega 0$ to $\omega 9$ so that the vehicle overcrowding state is gradually formed over the long period of time. That is, even when the operation is switched from an operation based on the normal timetable to an operation based on the vehicle overcrowding operation, the spacing adjustment unit 104 sets the time T0 and the waiting times $\omega 0$ to $\omega 9$ so that an operation schedule does not change rapidly. By doing so, the vehicular traffic system 1 according to the present embodiment can minimize influence on passengers that will get on, on the basis of a normal timetable. On the other hand, if it is determined that there is no time margin, the spacing adjustment unit 104 sets a period of time from time T0 to time T1 to be short and sets the respective waiting times $\omega 0$ to $\omega 9$ so that the vehicle overcrowding state is rapidly formed. In this case, corresponding waiting times $\omega 0$ to $\omega 9$ for decreasing the vehicle spacing in a short time is set. According to the spacing adjustment unit 104 of the present embodiment, since the vehicle overcrowding state can be formed rapidly even when there is no time margin as described above, it is possible to flexibly cope with a case in which the event schedule (for example, event end time) is changed suddenly.

Similarly, the spacing adjustment unit 104 sets the waiting time $\omega j$ on the basis of the number of passengers estimated at a reference station (destination station Hm) from the congestion information obtained in advance. This will be described in greater detail with reference to FIG. 3. When the operation is switched to the congestion elimination operation, the spacing adjustment unit 104 sets the waiting times ω1 to ω9 so that the vehicles 201 to 203 arrive and depart one after another at time intervals α at the destination station H10. Here, when the number of passengers estimated at the station H10 is smaller, the spacing adjustment unit 104 sets the values of the waiting times ω1 to ω9 so that the vehicle arrives and departs, for example at 1.2α intervals or 1.5α intervals. In this case, the spacing adjustment unit 104 sets the waiting times ω1 to ω9 to more slowly increase from ω1 to ω9. Conversely, when there is a larger number of passengers estimated at the station H10, the spacing adjustment unit 104 sets the values of waiting times ω1 to ω9 so that the time interval becomes shorter, and for example, so that the vehicle arrives or departs at 0.8α intervals or 0.5α intervals. In this case, the spacing adjustment unit 104 sets the waiting times ω1 to ω9 to more steeply increase from ω1 to ω9. By doing so, the vehicular traffic system 1 according to the present embodiment can minimize influence on the passengers that will get on, on the basis of a normal timetable in the same manner as described above. Further, when the time interval between arrival and departure at the destination station Hm is adjusted according to the number of passengers as described above, a possible riding amount per one of the respective vehicles 201 to 20*n* may be considered.

Further, the state in which the respective vehicles 201 to 203 stop at equal intervals at each station in an initial state in which the operation management device 10 starts the vehicle overcrowding operation has been described in the example illustrated in FIGS. 2 and 3. However, in an actual operation, the respective vehicles 201 to 203 are not necessarily present at equal intervals as illustrated in FIGS. 2 and 3 at a timing at which the operation management device 10 starts the vehicle overcrowding operation.

Therefore, when the vehicle overcrowding operation starts, the spacing adjustment unit 104 first recognizes the current positions of the respective vehicles 201 to 203 from the "position information" of the respective vehicles 201 to 203 acquired through the vehicle position acquisition unit 100. Also, the spacing adjustment unit 104 calculates a distance from the current position of each of the vehicles 201 to 203 to the destination station Hm. Here, for example, the position of the vehicle 201 in the initial state is assumed to be away from the destination station Hm as compared to the state illustrated in FIGS. 2 and 3. In this case, when the vehicle 201 waits for the waiting time ωj at each stop station Hj like the other vehicles 202 and 203, the vehicle 201 does not arrive at a place that enters an overcrowded state at time T1, and the overcrowded state cannot be completed. Accordingly, the spacing adjustment unit 104 performs a process of correcting the waiting time ωj at each station Hj for the vehicle 201.

Specifically, when the position of the vehicle 201 in the initial state is away from the destination station Hm as compared to the state illustrated in FIGS. 2 and 3 as in the above-described example, the spacing adjustment unit 104 performs a correction for setting the waiting time ωj for which the vehicle 201 should stop at each stop station Hj to be short for the vehicle 201. Since the waiting time ωj for which the vehicle 201 should stop at each stop station Hj is short, the vehicle 201 can arrive early at a position that should be in the overcrowded state.

As a more specific process example, when the distance from the current position of the vehicle 201 to the destination station Hm is L1, the spacing adjustment unit 104 multiplies each waiting time ωj by a predetermined coefficient p ($0<p\leq1$) that decreases in inverse proportion to an increase in the distance L1.

By doing so, as the distance of the vehicle 201 is away from the set destination station Hm, the waiting time ωj for which the vehicle 201 should wait at each stop station Hj is set to be smaller. Then, the vehicle 201 can arrive at a place that should be in the overcrowded state at time T1 regardless of a position at a time at which the vehicle overcrowding operation starts.

Further, while the case in which the respective stations H1 to H10 are all installed at equal intervals, the vehicles 201 to 203 travel between the stations at the same speed, and times from departure from one station of the respective vehicles 201 to 203 to stop at the next station are all "α" for simplicity has been described in the above description, the present invention is not limited to such an aspect in the actual operation of the vehicular traffic system 1. That is, in the vehicular traffic system 1, the stations Hj may be installed at different intervals at respective stations, and travel times among the stations may be different.

(Process Flow of Operation Management Device According to First Embodiment)

Figure 4:
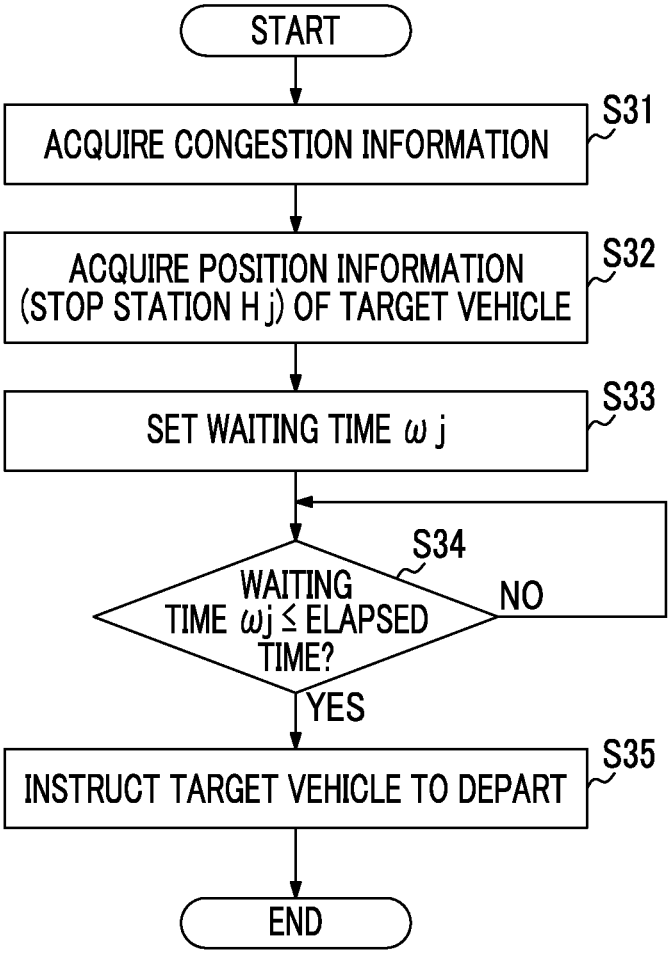
FIG. 4 is a flowchart illustrating a process flow of an operation management device according to the first embodiment of the present invention.

FIG. 4 is a flowchart illustrating a process flow of the operation management device according to the first embodiment of the present invention.

The operation management device 10 according to the present embodiment executes a process flow (FIG. 4) to be described below using the vehicle position acquisition unit 100, the spacing adjustment unit 104, and the departure determination unit 102 described above.

First, the spacing adjustment unit 104 acquires congestion information on the basis of a determination of a manager who obtains predetermined event information in advance (step S31). The congestion information is information indicating, for example, an expected number of passengers, an expected congestion occurrence time, and a station at which the congestion occurs.

Then, the vehicle position acquisition unit 100 acquires position information indicating a position in which a specific target vehicle 20*i* is present (step S32). Here, the vehicle position acquisition unit 100 receives and acquires the position information indicating the position of the own vehicle from the target vehicle 20*i*.

Next, the spacing adjustment unit 104 sets the start time T0 of the vehicle overcrowding operation and the waiting time ωj for each station Hj on the basis of the congestion information acquired in step S31 and the position information acquired in step S32 (step S33). Here, the spacing adjustment unit 104 sets the start time T0 and a basic waiting time ωj' for each stop station Hj to gradually increase as the vehicle approaches the destination station Hm on the basis of the congestion information. Also, the spacing adjustment unit 104 performs correction according to the position information of each of the vehicles 201 to 20*n* (multiplies the basic waiting time ωj' by the coefficient p) to calculate the waiting time ωj for each station Hj for each of the vehicles 201 to 20*n*.

Also, the departure determination unit 102 executes a process in which the target vehicle 20*i* waits for the waiting time ωj at the stop station Hj on the basis of the waiting time ωj set in step S33. Specifically, the departure determination unit 102 determines whether the elapsed time is equal to or greater than the waiting time ωj after the target vehicle 20*i* stops at the station Hj (step S34). When the elapsed time is less than the waiting time ωj (NO in step S34), the departure determination unit 102 repeats step S34 to suspend the transmission of the departure instruction to the target vehicle 20*i*. Also, when the elapsed time is equal to or greater than the waiting time ωj (YES in step S34), the departure determination unit 102 transmits the departure instruction to the target vehicle 20*i* (step S35).

Further, in the above-described flowchart, the operation management device 10 executes the process flow from step S32 to step S35 for each of the vehicles 201 to 20*n*. Further, the operation management device 10 repeats the process flow of step S34 for one target vehicle 20*i* each time the vehicle stops the stop station Hj.

The operation management device 10 according to the present embodiment executes the process flow (FIG. 4), and thus, a state in which density of the presence of the vehicles 201 to 20*n* increases at the congestion occurrence station (station Hm) at a congestion occurrence time (time T1) is formed. Further, the density of the presence of the vehicles 201 to 20*n* in this case is set so that a supply and demand balance is suitable according to the expected number of passengers.

As described above, according to the vehicular traffic system 1 of the first embodiment of the present invention, density of provision of a transportation service using the vehicles can be flexibly changed at a desired time and at a desired station.

Further, the spacing adjustment unit 104 according to the first embodiment described above has been described as setting the waiting time ωj to gradually increase at the station closer to the destination station Hm, the vehicular traffic system 1 according to the present embodiment is not limited to such a process. The spacing adjustment unit 104 may appropriately set the waiting time ωj at each station Hj according to original characteristics of the vehicular traffic system 1. For example, in the example illustrated in FIG. 3, when there normally are a large number of passengers at a specific station (for example, station H6), the waiting time ω6 may be set to be smaller than the waiting times ω1 to ω5 on the basis of a vehicle overcrowding operation at the station H6. The spacing adjustment unit 104 may set another waiting time ωj so that the vehicle overcrowding state is formed at the destination station H10 after performing such exceptional coping.

Further, the spacing adjustment unit 104 may set the waiting time ωj according to a normal stop time that is determined for each station in a normal operation in advance. For example, when a normal waiting time Td1 at the station H1, a normal waiting time Td2 at the station H2, . . . have been determined in the normal operation, the spacing adjustment unit 104 sets ω1=Td1×r1, ω2=Td2×r2, . . . . Here, r1, r2, . . . are values equal to or greater than 1. In this case, the spacing adjustment unit 104 sets r1< r2< . . . . By doing so, the spacing adjustment unit 104 can form the vehicle overcrowding state even when the stop times at respective stations in the normal operation are different.

Further, the spacing adjustment unit 104 according to the first embodiment described above sets the waiting time ωj at the station Hj closer to the destination station Hm to gradually increase to form the vehicle overcrowding state, but the vehicular traffic system 1 according to the present embodiment is not limited to such a process. For example, the spacing adjustment unit 104 may gradually decrease a travel speed between the respective stations closer to the destination station Hm to form the vehicle overcrowding state at the destination station Hm at a desired time.

Second Embodiment

Next, a vehicular traffic system according to a second embodiment of the present invention will be described.

Figure 5:
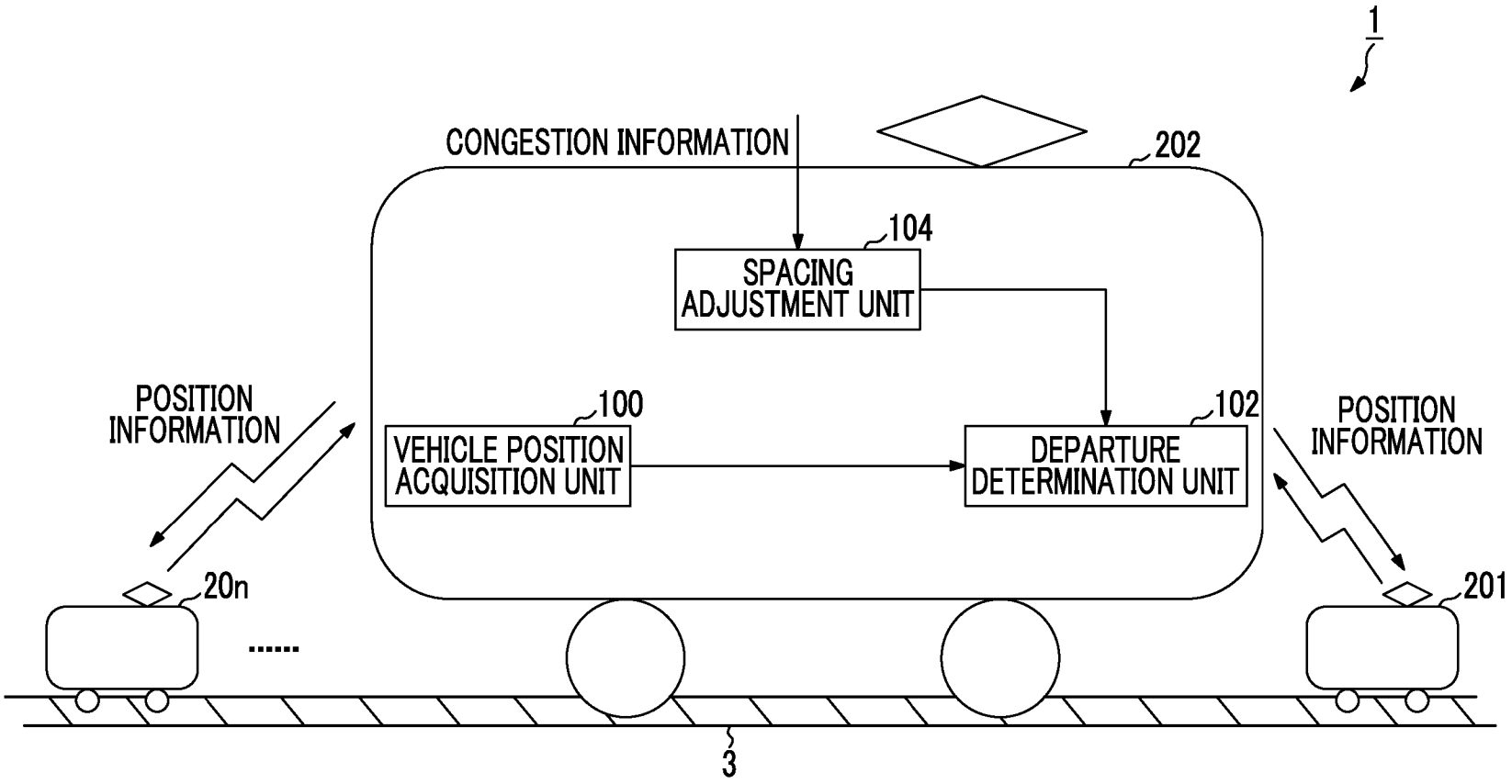
FIG. 5 is a diagram illustrating a functional configuration of a vehicular traffic system according to a second embodiment of the present invention.

FIG. 5 is a diagram illustrating a functional configuration of a vehicular traffic system according to the second embodiment of the present invention. Among the functional components of the vehicular traffic system 1 according to the second embodiment, the same functional components as the vehicular traffic system 1 (FIG. 1) according to the first embodiment are denoted with the same reference signs, and description thereof is omitted.

The vehicular traffic system 1 according to the second embodiment of the present invention does not include the operation management device 10 that is a ground facility in the first embodiment. Also, each of the vehicles 201 to 20*n* includes the vehicle position acquisition unit 100, the spacing adjustment unit 104, and the departure determination unit 102 included in the operation management device 10 in the first embodiment (further, for convenience, although functional components of only the vehicle 202 are shown in FIG. 5, in fact, each of the vehicles 201 to 20*n* includes the same functional components as the vehicle 202).

Here, according to the vehicular traffic system 1 of the present embodiment, each of the vehicles 201 to 20*n* can autonomously perform a vehicle overcrowding operation while communicating with the other vehicles 201 to 20*n*. Specifically, the spacing adjustment unit 104 of each of the vehicles 201 to 20*n* acquires the same congestion information from the predetermined information source (for example, an event manager) described above (step S31 in FIG. 4). Further, a station estimated to be congested (destination station Hm) and a time at which congestion is estimated (congestion occurrence time T1) are included in this congestion information.

Then, the vehicle position acquisition unit 100 of each of the vehicles 201 to 20*n* acquires position information indicating the position in which the own vehicle is present (step S32 in FIG. 4). Here, the vehicle position acquisition unit 100 acquires a current position of the own vehicle on the basis of the number of tire rotations and the information received from the position detection device, and acquires position information for another vehicle through communication means with the other vehicle.

Next, the spacing adjustment unit 104 of each of the vehicles 201 to 20*n* sets a start time T0 of the vehicle overcrowding operation and the waiting time ωj for each station Hj on the basis of the congestion information acquired in step S31 and the position information of each of the vehicles 201 to 20*n* acquired in step s32 (step S33 in FIG. 4). Here, the spacing adjustment unit 104 sets the start time T0 and a basic waiting time ωj' for each stop station Hj to gradually increase as the vehicle approaches the destination station Hm on the basis of the congestion information. Also, the spacing adjustment unit 104 performs correction according to the position information of the own vehicle (multiplies the basic waiting time ωj' the coefficient p) to calculate the waiting time ωj for each stop station Hj for the own vehicle.

Also, the departure determination unit 102 executes a process of waiting for the waiting time ωj at the stop station Hj of the own vehicle on the basis of the waiting time ωj set in step S33. Specifically, the departure determination unit 102 determines whether the elapsed time is equal to or greater than the waiting time ωj after the own vehicle stops at the station Hj (step S34 in FIG. 4). When the elapsed time is less than the waiting time ωj (NO in step S34 of FIG. 4), the departure determination unit 102 repeats step S34 to suspend the departure instruction of the own vehicle. Also, when the elapsed time is equal to or greater than the waiting time ωj (YES in step S34 of FIG. 4), the departure determination unit 102 transmits the departure instruction to the own vehicle (step S35 in FIG. 4).

As described above, according to the vehicular traffic system 1 of the present embodiment, each of the vehicles 201 to 20*n* can autonomously execute the vehicle overcrowding operation on the basis of the determined waiting time ωj. Accordingly, it is not necessary to perform the operation using a ground facility (operation management device 10) that centrally manages the entire operation of the vehicles 201 to 20*n*, and it is possible to achieve distribution of the operation management process. If the distribution of the operation management process is made in this way, influence on the operation of the vehicular traffic system 1 is minimized even when any of the respective operation management systems (the vehicles 201 to 20*n* in the case of the present embodiment) fails, and thus, it is possible to improve the reliability of the entire vehicular traffic system 1.

Further, the vehicular traffic system 1 according to the first and second embodiments described above may further include a passenger information system (PIS) as a ground facility. A conventional PIS displays a scheduled arrival time of a vehicle on a screen provided at a station on the basis of a predetermined timetable, whereas in the case of the vehicular traffic system 1 according to the present embodiment, since the operation (the vehicle overcrowding operation and the congestion elimination operation) that does not use the timetable is performed, an arrival vehicle and an arrival time cannot be recognized on the basis of only timetable information. Therefore, the PIS according to the present embodiment performs a process of receiving the identification information, the position information, the path information, and the waiting time ωj at each station of the target vehicle 20*i* from the operation management device 10 (each of the vehicles 201 to 20*n* in the case of the second embodiment), calculating the scheduled arrival time for each station of the target vehicle 20*i*, and displaying the scheduled arrival time on a display screen installed in each station. Here, the identification information of the target vehicle 20*i* may be a unique ID (IDentification) number or the like for specifying the target vehicle 20*i*. After specifying the target vehicle 20*i* from the identification information, the PIS according to the present embodiment can easily estimate a time required until at least the next stop station from, for example, a travel speed of the target vehicle 20*i* when the position information and the path information can be recognized.

Further, the vehicular traffic system 1 according to the present invention may also be realized by the following embodiment.

Third Embodiment

Hereinafter, a vehicular traffic system according to a third embodiment of the present invention will be described with reference to the drawings.

Figure 6:
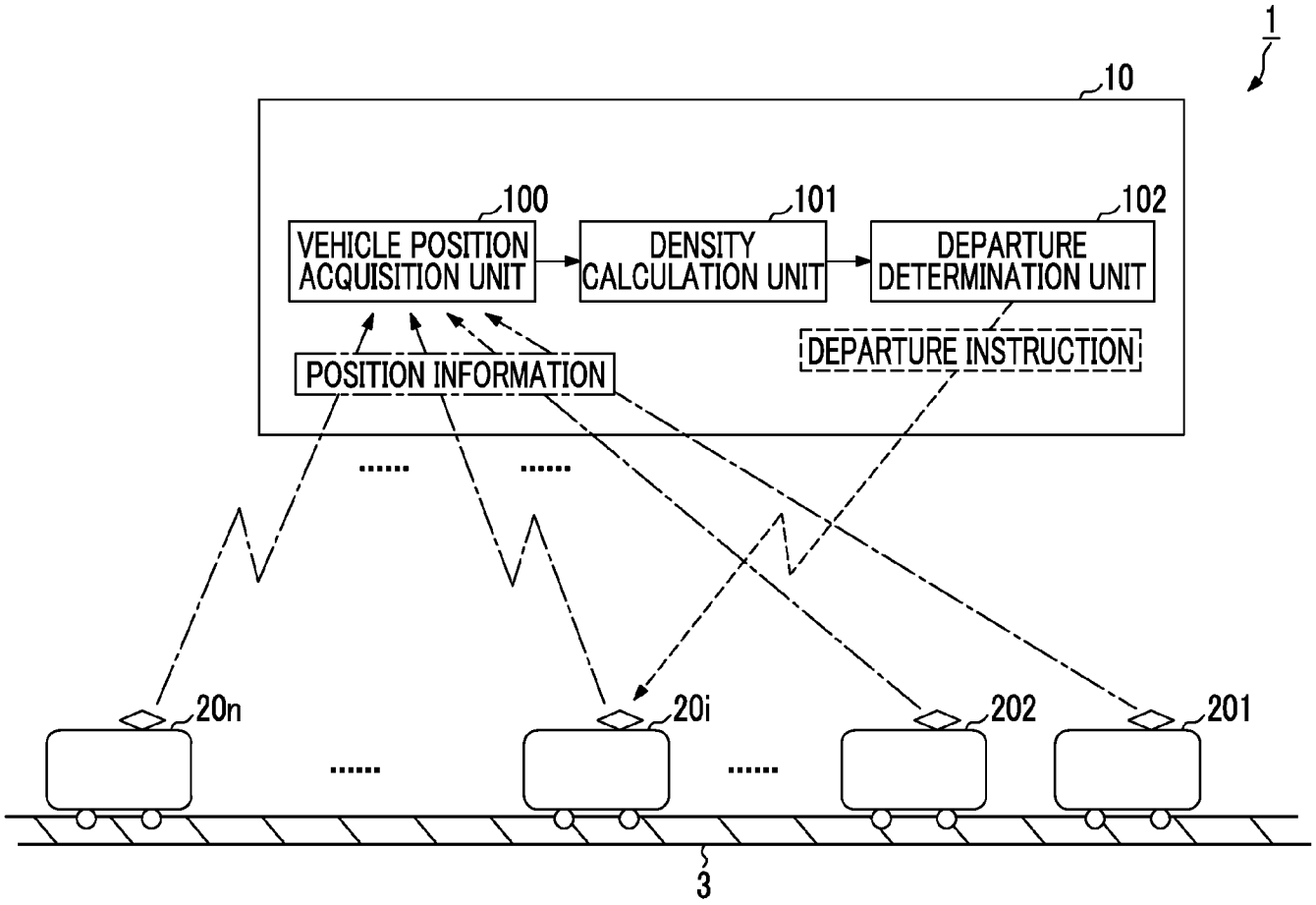
FIG. 6 is a diagram illustrating a functional configuration of a vehicular traffic system according to a third embodiment of the present invention.

FIG. 6 is a diagram illustrating a functional configuration of the vehicular traffic system according to third embodiment of the present invention. In FIG. 6, reference sign 1 indicates a vehicular traffic system.

(Configuration of Entire Vehicular Traffic System)

First, an entire configuration of the vehicular traffic system 1 will be described.

As illustrated in FIG. 6, the vehicular traffic system 1 according to the present embodiment includes an operation management device 10, and a plurality of vehicles 201, 202, . . . , 20*n* (n is an integer equal to or greater than 2) traveling along a track 3. The operation management device 10 is referred to as a ground facility, and is a device that controls the operation of the plurality of vehicles 201, 202, . . . , and 20*n*.

The operation management device 10 according to the present embodiment is a functional unit that transmits a departure instruction to each of the vehicles 201, 202, . . . , 20*n* on the basis of the determination of the departure determination unit 102 to be described below. The operation management device 10 transmits a departure instruction to each of the vehicles 201 to 20*n* using wireless communication means or the like. Each of the vehicles 201 to 20*n* operates on the basis of the departure instruction received from the operation management device 10.

The vehicles 201, 202, . . . , 20*n* are a train traveling along the track 3 (line). A security device (interlocking device) controls a signal on the basis of path request information transmitted by the operation management device 10, and the vehicles 201 to 20*n* travel while arriving at and departing from a plurality of stations (not illustrated in FIG. 6) provided along the track 3 according to the signal. Further, predetermined position detection devices (not illustrated) are provided at regular intervals in the track 3, and each of the vehicles 201 to 20*n* communicates with the position detection devices, and accordingly, can recognize a position on the track 3 in which the own vehicle is traveling.

This function will be described in greater detail. Each of the vehicles 201 to 20*n* includes its own line database. Also, each of the vehicles 201 to 20*n* has a function of measuring the number of tire rotations of the own vehicle to calculate a travel distance and recognizing a current position of the own vehicle. However, in this case, the current position recognized from the number of tire rotations may deviate from an actual position due to tire slip. Each of the vehicles 201 to 20*n* corrects the deviation through a comparison with a position detection device placed on the ground, and accurately recognizes a position on the track 3 in which the own vehicle is traveling.

Here, in a high density line section as arranged in an inner city portion (a line in which the number of operations of the vehicle is relatively large), it may be important for the vehicle to arrive and depart at regular time intervals, rather than coming and going according to a timetable. That is, a passenger does not use a transportation service with recognition of a definite arrival and departure time, and there are a number of passengers using the transportation service with recognition of an approximate travel time to a destination station on the basis of a time interval of coming and going of the vehicle. In this case, the passenger lays weight on the vehicle coming and going at desired time intervals, rather than the vehicle departing and arriving on time. Here, in operation control to perform timetables change work to eliminate disturbance of the operation, the timetable changing work consumes time. Accordingly, as a result, it takes excessive time to eliminate the disturbance of the operation. It is believed that an appropriate transportation service can be provided to passengers by rapidly uniformizing the time intervals among the respective vehicles regardless of the timetable. Accordingly, the vehicular traffic system 1 according to the present embodiment has a function of more rapidly uniformizing the time intervals among the respective vehicles on the basis of the operation of the operation management device 10 to be described below when a delay occurs in a specific vehicle and provision of the transportation service is nonuniform.

(Configuration of Operation Management Device)

Next, a configuration of the operation management device 10 will be described.

As illustrated in FIG. 6, the operation management device 10 according to the present embodiment includes a vehicle position acquisition unit 100, a density calculation unit 101, and a departure determination unit 102.

The vehicle position acquisition unit 100 is a functional unit that acquires positions of the plurality of vehicles 201 to 20*n* present on the track 3. Each of the vehicles 201 to 20*n* can communicate with a position detection device (not illustrated) provided on the track 3 to recognize a position on the track 3 in which the own vehicle is traveling, as described above. Also, the respective vehicles 201 to 20*n* sequentially transmit "position information" indicating the positions of the own vehicles to the operation management device 10 through wireless communication. The vehicle position acquisition unit 100 of the operation management device 10 receives the position information of the respective vehicles 201 to 20*n* to acquire the positions of the vehicles 201 to 20*n*. Further, in another embodiment, each of the vehicles 201 to 20*n* may transmit the position information to the operation management device 10 through wired communication.

The density calculation unit 101 is a functional unit that calculates density of the plurality of vehicles 201 to 20*n* that travel within a predetermined range on the track 3. Specifically, the density calculation unit 101 acquires the number of vehicles traveling within the predetermined range on the basis of the positions of the respective vehicles 201 to 20*n* acquired by the vehicle position acquisition unit 100. The density calculation unit 101 stores the number of vehicles as the "density" of the vehicles traveling within the predetermined range. A specific function of the density calculation unit 101 will be described below.

The departure determination unit 102 is a functional unit that adjusts a departure time at a stop station of a predetermined target vehicle 20*i* (i is an integer satisfying $1 \leq i \leq \square n$, the same applies below) on the basis of one or both of a "front direction density Df" and a "rear direction density Dr" of the target vehicle 20*i*. Here, "to adjust a departure time" is specifically to adjust a departure time by changing a time to transmit a departure instruction to the target vehicle 20*i*.

Here, the front direction density Df is density of the vehicles traveling in the predetermined range at the front in the travel direction of the target vehicle 20*i*. Further, the rear direction density Dr is density of vehicles traveling within a predetermined range at the rear in the travel direction of the target vehicle 20*i*. Specifically, the departure determination unit 102 performs a process of suspending transmission of the departure instruction of the target vehicle 20*i* until predetermined conditions are satisfied on the basis of one or both of the "front direction density Df" and the "rear direction density Dr". Also, the departure determination unit 102 performs a process of transmitting the departure instruction at a timing at which the predetermined conditions have been satisfied. The target vehicle 20*i* departs from the stop station at a timing at which the departure instruction has been received (more precisely, requirements for another departure have been satisfied).

Also, in another embodiment, instead of the above aspect, the departure determination unit 102 may perform a process of continuing to transmit a predetermined "departure suspending instruction" while the predetermined conditions have been not satisfied, and stopping the transmission of the departure suspending instruction (releasing the departure suspending instruction) at a timing at which the predetermined conditions have been satisfied. In this case, the target vehicle 20*i* does not depart while continuing to receive the departure suspending instruction, and departs from the stop station at a timing at which the departure suspending instruction has been released.

Specific content of predetermined conditions on the basis of one or both of "front direction density Df" and "rear direction density Dr" will be described below.

(Functions of Density Calculation Unit and Departure Determination Unit)

Figure 7:
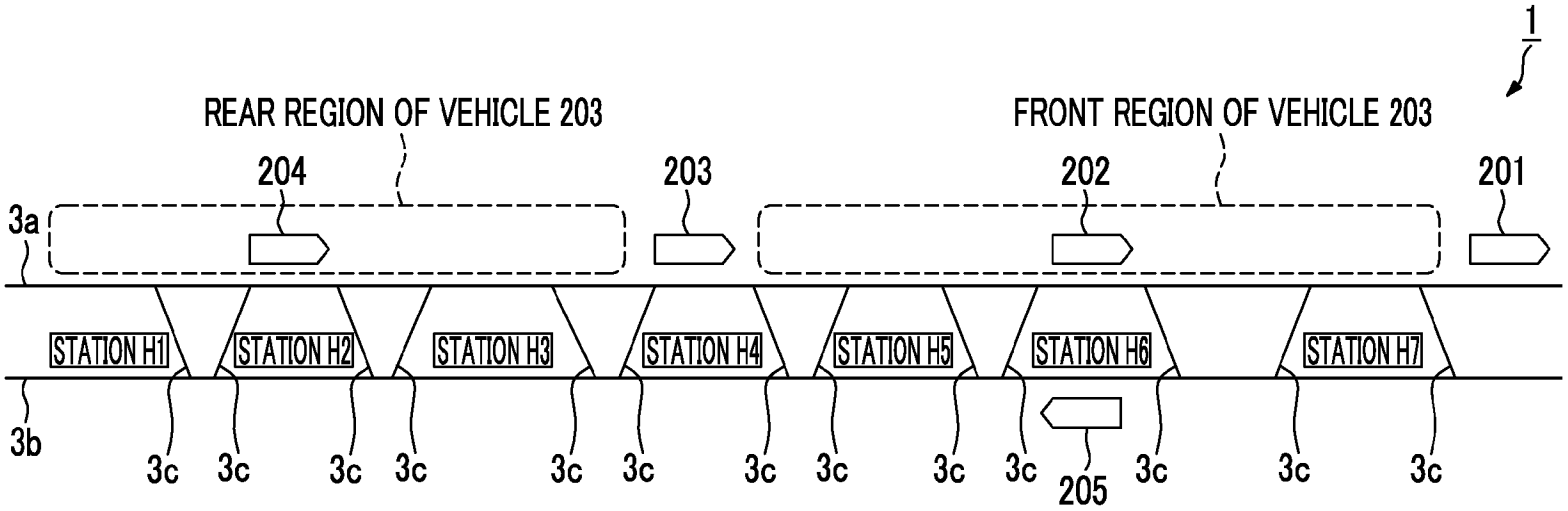
FIG. 7 is a diagram illustrating functions of a density calculation unit and a departure determination unit according to the third embodiment of the present invention.

FIG. 7 is a diagram illustrating functions of the density calculation unit and the departure determination unit according to the third embodiment of the present invention. Further, vehicles 201 to 204 illustrated in FIG. 7 are vehicles that travel along a first track 3*a* from the left of a paper surface to the right. On the other hand, a vehicle 205 is a vehicle that travels along a second track 3*b* different from the first track 3*a* from the right of the paper surface to the left. The respective vehicles 201 to 205 travel in the respective travel directions while arriving at and departing from each station illustrated in FIG. 7. Further, a plurality of branch roads 3*c* are provided between the first track 3*a* and the second track 3*b*, and each of the vehicles 201 to 205 may follow a path to and from the first track 3*a* and the second track 3*b* via the branch road 3*c*.

Hereinafter, the function of the density calculation unit 101 will be described with reference to FIG. 7.

The density calculation unit 101 calculates the "front direction density Df" and the "rear direction density Dr" for each of the vehicles 201 to 20*n* on the basis of the position information of each of the vehicles 201 to 20*n* acquired by the vehicle position acquisition unit 100. Specifically, the density calculation unit 101 according to the present embodiment acquires the number of the vehicles 201 to 20*n* which travel within the range from the nearest position in front in the travel direction of the specific target vehicle 20*i* to kf stations in front in the travel direction (kf is an integer equal to or greater than 1), and calculates the front direction density Df of the target vehicle 20*i* to be "Df=number of vehicles/kf". Similarly, the density calculation unit 101 acquires the number of the vehicles 201 to 20*n* which travel within the range from the nearest position at the rear in the travel direction of the target vehicle 20*i* to kr stations at the rear in the travel direction (kr is an integer equal to or greater than 1), and calculates the rear direction density Dr of the target vehicle 20*i* to be "Dr=number of vehicles/kr". Further, in the following description, a range from the nearest position in front in the travel direction of the target vehicle 20*i* to front kf stations in the travel direction is referred to as a "vehicle 20*i* front region". Further, a range from the nearest position at the rear in the travel direction of the target vehicle 20*i* to rear kr stations in the travel direction is referred to as a "vehicle 20*i* rear region".

FIG. 7 illustrates, for example, a case in which the target vehicle 20*i* is the vehicle 203, and the density calculation unit 101 obtains the front direction density Df and the rear direction density Dr of the vehicle 203 within the range of three stations (kf=3) in front in the travel direction of the vehicle 203 and three stations (kr=3) at the rear thereof. The vehicle 203 stops at a station H4, as illustrated in FIG. 7. In this case, a front region of the vehicle 203 is a range determined to be a section from a nearest position in front in the travel direction of the own vehicle to a station H7 (FIG. 7). On the other hand, a rear region of the vehicle 203 is a range determined to be a section from a nearest position at the rear in the travel direction of the own vehicle to the station H3 (FIG. 7). Further, the front region of the vehicle 203 and the rear region of the vehicle 203 move to follow the travel of the vehicle 203. For example, if the vehicle 203 has moved from the station H4 to the station H5, the front region of the vehicle 203 includes three stations (stations H6 to H8 (the station H8 is not illustrated)) in front in the travel direction from the station H5, and the rear region of the vehicle 203 includes the three stations (stations H2 to H4) at the rear in the travel direction from the station H5.

According to the example illustrated in FIG. 7, another vehicle 202 is present in the front region (kf=3) of the vehicle 203. Accordingly, the density calculation unit 101 calculates the front direction density Df to be "1/3". Another vehicle 204 is present in the rear region (kr=3) of the vehicle 203. Accordingly, the density calculation unit 101 calculates the rear direction density Dr to be "1/3". Further, when the density calculation unit 101 calculates the front direction density Df, the density calculation unit 101 considers only the vehicles 201 to 20*n* that travel in advance along a path along which the vehicle 203 is scheduled to travel. Accordingly, in the example illustrated in FIG. 7, in the calculation of the front direction density Df of the vehicle 203, the vehicle 205 traveling along a path (second track 3*b*) different from the path (first track 3*a*) along which the vehicle 203 is scheduled to travel is not considered. Further, in the calculation of the rear direction density Dr, the other vehicles 201 to 20*n* traveling along the path (second track 3*b*) different from the path (first track 3*a*) along which the vehicle 203 has traveled is not considered.

Next, a function of the departure determination unit 102 will be described.

The departure determination unit 102 adjusts a departure time at a stop station of the target vehicle 20*i* on the basis of the front direction density Df and the rear direction density Dr of the target vehicle 20*i*. Specifically, when a front and rear direction density difference ΔD that is a value obtained by subtracting the rear direction density Dr from the front direction density Df exceeds a predetermined density difference threshold value α (α is a value greater than or equal to 0) (ΔD>α), the departure determination unit 102 suspends transmission of the departure instruction to the target vehicle 20*i* until conditions that the front and rear direction density difference ΔD is equal to or less than the density difference threshold value α (ΔD≤α) are satisfied, to delay the departure time of the target vehicle 20*i*.

Here, the density difference threshold value α is assumed to have been set to "0". In this case, according to the example illustrated in FIG. 7, the departure determination unit 102 calculates the front and rear direction density difference ΔD to be "ΔD=0 (=Df−Dr)" from the front direction density Df=1/3 and the rear direction density Dr=1/3 for the vehicle 203 that is the target vehicle 20*i*. Then, the vehicle 203 satisfies ΔD≤α (=0), and thus, the departure determination unit 102 transmits the departure instruction to the vehicle 203 at a predetermined timing of departure. The vehicle 203 receives the departure instruction and departs from the slop station H4.

Here, in the above-described description, in the departure determination unit 102, conditions that the transmission of the departure instruction to the target vehicle 20*i* is suspended are ΔD>α, and conditions that the departure instruction is transmitted to the target vehicle 20*i* are also ΔD≤α. However, in the departure determination unit 102 according to another embodiment, the conditions that the transmission of the departure instruction to the target vehicle 20*i* is suspended may be ΔD>α, and the conditions that the departure instruction is transmitted to the target vehicle 20*i* may be ΔD≤β (<α) using β different from α.

By doing so, a period in which the departure instruction is suspended is set to be longer, and thus, it is possible to reduce a frequency at which adjustment is performed.

(Process Flow of Operation Management Device According to Third Embodiment)

Figure 8:
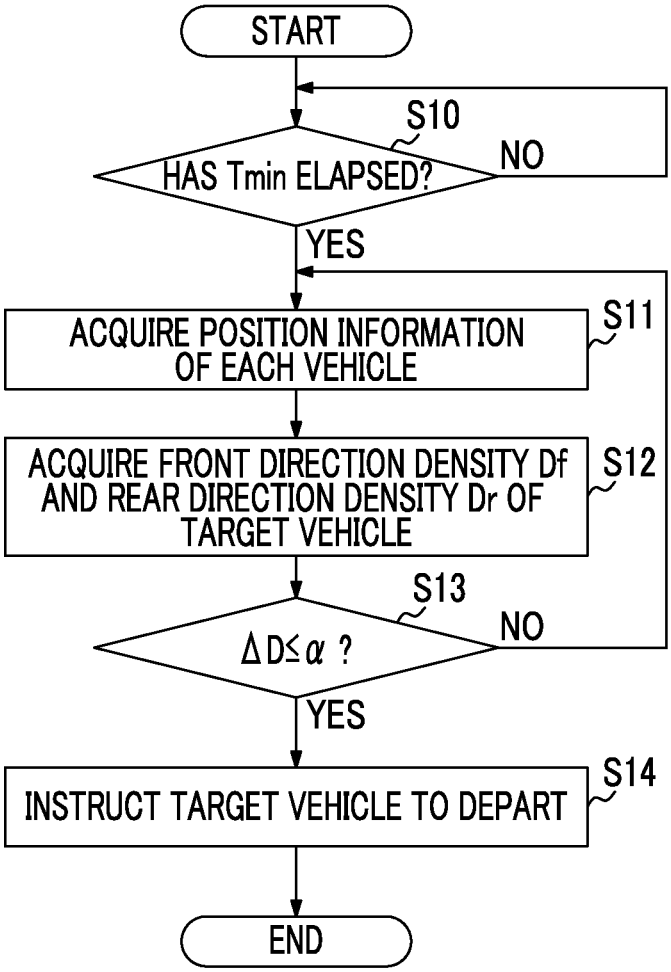
FIG. 8 is a flowchart illustrating a process flow of an operation management device according to the third embodiment of the present invention.

FIG. 8 is a flowchart illustrating a process flow of the operation management device according to the third embodiment of the present invention.

The operation management device 10 according to the present embodiment executes the process flow to be described below (FIG. 8) using the vehicle position acquisition unit 100, the density calculation unit 101, and the departure determination unit 102 described above. Further, the process flow in FIG. 8 is a process flow until the departure instruction is transmitted to the target vehicle 20*i* which has stopped at a predetermined station.

In the operation management device 10 according to the present embodiment, a minimum stop time Tmin which is a period of time in which each of the vehicles 201 to 20*n* should at least stop at the stop station in order to ensure a time taken for a passenger to get on or off is defined in advance. The departure determination unit 102 of the operation management device 10 first determines whether the minimum stop time Tmin has elapsed after receiving a notification indicating that the target vehicle 20*i* arrives at the stop station (step S10). Here, when the minimum stop time Tmin has not elapsed ("NO" in step S10), the process does not proceed to the next step until the minimum stop time Tmin elapses.

If the minimum stop time Tmin has elapsed ("YES" in step S10), the vehicle position acquisition unit 100 of the operation management device 10 first acquires the position information of the respective vehicles 201 to 20*n* traveling along the track 3 from the vehicles 201 to 20*n* (step S11). Further, as described above, each of the vehicles 201 to 20*n* can appropriately acquire, for example, the number of tire rotations of the own vehicle, or position information indicating an exact position of the own vehicle by communicating with position detection devices (not illustrated) provided at regular intervals in the track 3. Here, the position information is, for example, information represented in km on the track 3. Specifically, each of the vehicles 201 to 20*n* acquires a position (km) in which the position detection device has been installed on the tracks 3 through the communication with the position detection device, and uniquely defines the position (km) of the own vehicle on the basis of an elapsed time from a timing of the communication, a travel speed, or the like.

Further, means with which the vehicle position acquisition unit 100 acquires the position information of each of the vehicles 201 to 20*n* is not limited to the above-described embodiment. For example, the position of each of the vehicles 201 to 20*n* may be acquired from predetermined coordinate information received by the respective vehicles 201 to 20*n* from a satellite on the basis of a GPS (Global Positioning System).

Then, the density calculation unit 101 calculates the front direction density Df and the rear direction density Dr for the target vehicle 20*i* on the basis of the position information of each of the vehicles 201 to 20*n* acquired in step S11 (step S12). Also, the departure determination unit 102 calculates the front and rear direction density difference ΔD on the basis of the front direction density Df and the rear direction density Dr calculated in step S12, and determines whether the front and rear direction density difference ΔD is equal to or less than the density difference threshold value α (step S13). Here, when the condition that the front and rear direction density difference ΔD is equal to or less than the density difference threshold value α is not satisfied ("NO" in step S13), the departure determination unit 102 proceeds to step S11 and performs the process of acquiring the position information and calculating the front direction density Df and the rear direction density Dr again. On the other hand, when the condition that the front and rear direction density difference ΔD is equal to or less than the density difference threshold value α is satisfied ("YES" in step S13), the departure determination unit 102 immediately transmits the departure instruction to the target vehicle 20*i* (step S14).

The operation management device 10 executes the above-described process flow to realize a process of suspending departure of the target vehicle 20*i* when the front and rear direction density difference ΔD is greater than the density difference threshold value α and transmitting the departure instruction to the target vehicle 20*i* at a time at which the front and rear direction density difference ΔD is less than the density difference threshold value α.

Further, in the example of the above-described flowchart, the departure determination unit 102 of the operation management device 10 first determines whether the minimum stop time Tmin has elapsed to detect that the minimum stop time Tmin has elapsed in step S10, and then, performs the departure determination based on the determination of the front direction density Df, the rear direction density Dr, and the front and rear direction density difference ΔD (steps S11 to S13). However, other embodiments are not limited to such a processing order. For example, the operation management device 10 may perform the determination as to whether the minimum stop time Tmin has elapsed (step S10) after the determination of the front and rear direction density difference ΔD has been performed or may perform the determination simultaneously with and in parallel to the determination of the front and rear direction density difference ΔD. More specifically, for example, the operation management device 10 first performs the process in steps S11, S12, and S13, and repeats the process when the determination of the front and rear direction density difference ΔD is NO in step S13. Also, the operation management device 10 may then perform the determination as to whether the minimum stop time Tmin has elapsed (step S10) when the determination is YES in step S13, and may perform a process of executing steps S11, S12, and S13 again when the determination is NO.

By doing so, the process of comparing the front direction density with the rear direction density (steps S11 to S13) is performed without waiting for the minimum stop time Tmin, and thus, it is possible to include a time required for the process itself in the waiting time of Tmin, and to eliminate a delay of departure instruction transmission.

(Effects of Operation Management Device According to Third Embodiment)

Figure 9A:
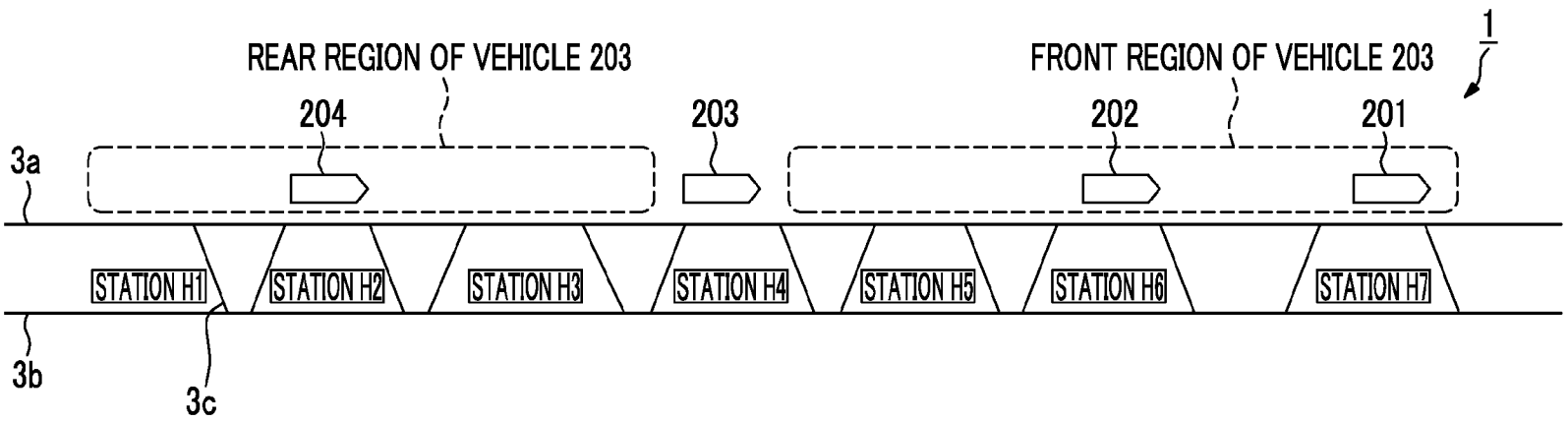
FIG. 9A is a first diagram illustrating effects of the vehicular traffic system according to the third embodiment of the present invention.
Figure 9B:
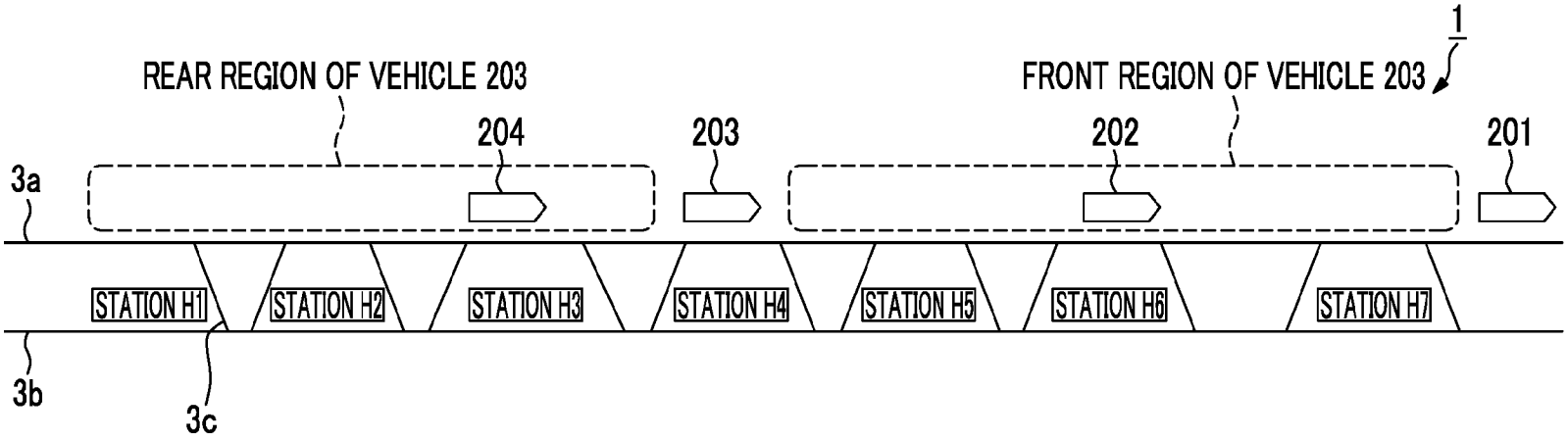
FIG. 9B is a second diagram illustrating effects of the vehicular traffic system according to the third embodiment of the present invention.
Figure 10A:
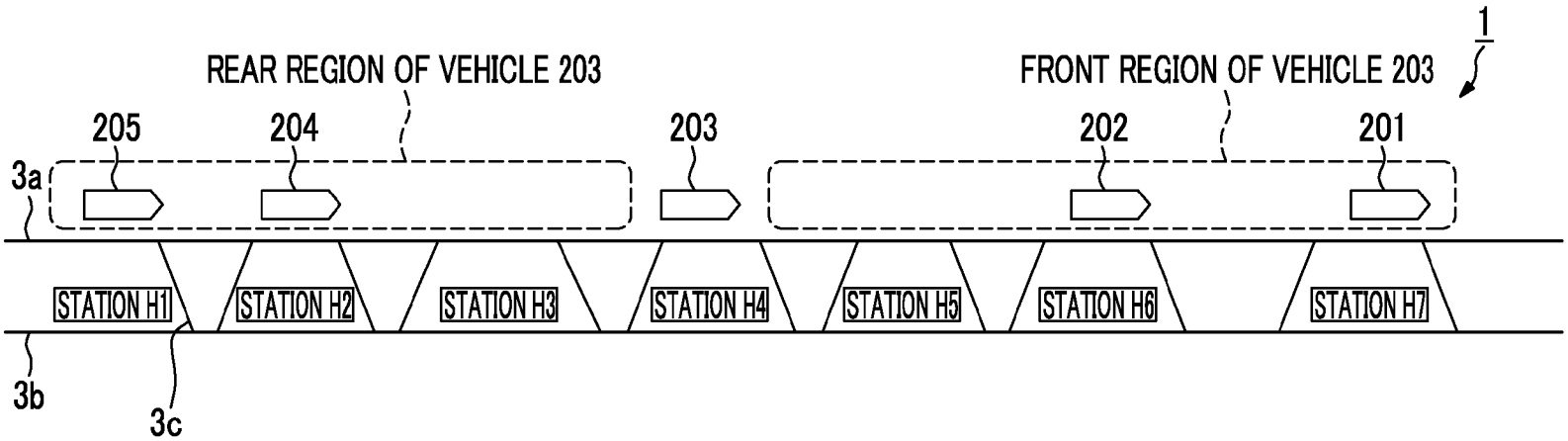
FIG. 10A is a third diagram illustrating effects of the vehicular traffic system according to the third embodiment of the present invention.
Figure 10B:
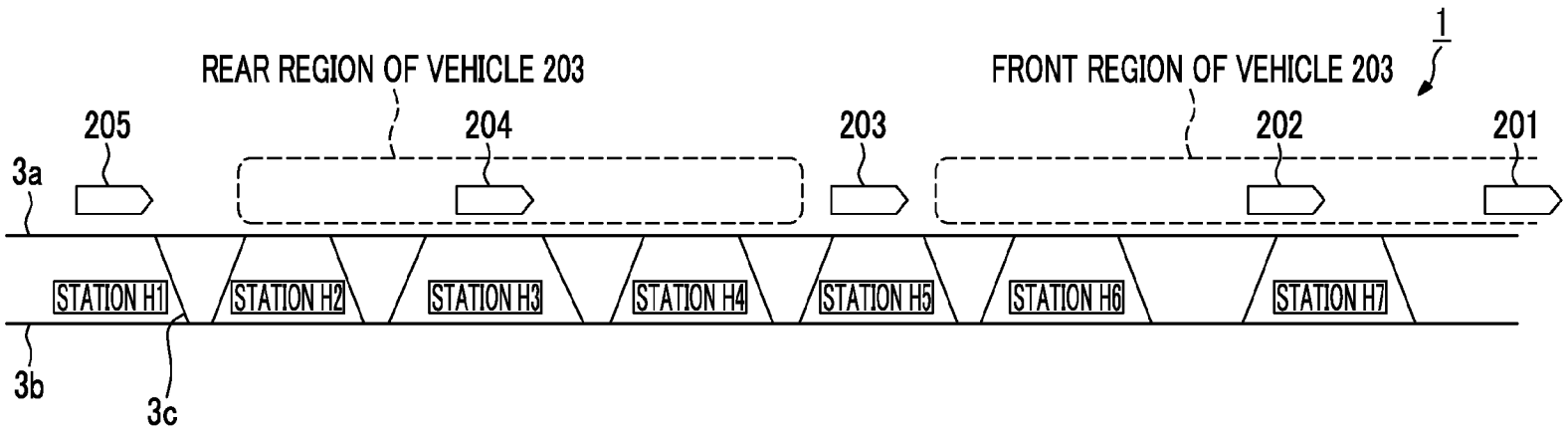
FIG. 10B is a fourth diagram illustrating effects of the vehicular traffic system according to the third embodiment of the present invention.

FIGS. 9A and 9B are first and second diagrams illustrating effects of the vehicular traffic system according to the third embodiment of the present invention. The respective vehicles 201 to 204 illustrated in FIGS. 9A and 9B are vehicles that travel along a first track 3*a* from the left of a paper surface to the right. Further, FIGS. 10A and 10B are third and fourth diagrams illustrating effects of the vehicular traffic system according to the third embodiment of the present invention. The respective vehicles 201 to 205 illustrated in FIGS. 10A and 10B are vehicles that travel along the first track 3*a* from the left of a paper surface to the right, as in FIGS. 9A and 9B.

The operation management device 10 of the vehicular traffic system 1 according to the present embodiment performs operation management so that the vehicles 201 to 20*n* operate at equal intervals on the basis of the processes of the respective functional units of the vehicle position acquisition unit 100, the density calculation unit 101, and the departure determination unit 102 described above. Here, specific effects of the operation management of the operation management device 10 according to the present embodiment will be described with reference to FIGS. 9A and 9B and FIGS. 10A and 10B. Further, in an example described with reference to FIGS. 9A and 9B and FIGS. 10A and 10B, the example is focused on the operation of the vehicle 203 as the target vehicle 20*i*, and it is assumed that kf=kr=3 and α=0, as in the example illustrated in FIG. 7.

First, effects of the operation management performed in consideration of the front direction density Df will be described with reference to FIGS. 9A and 9B.

In FIG. 9A, a state in which a vehicle (not illustrated) that travels in front in the travel direction of the vehicle 201 traveling on the first track 3*a* suffers from any trouble and the departure time is delayed in the vehicular traffic system 1 is illustrated. As illustrated in FIG. 9A, vehicle spacing between the vehicle 201 and the vehicle 202 is shorter than a normal vehicle spacing under the influence of the delay of the departure time. Here, the description is focused on the vehicle 203 illustrated in FIG. 9A. The density calculation unit 101 detects that two vehicles including the vehicle 201 and the vehicle 202 are present in the front region of the vehicle 203 on the basis of the position information acquired through the vehicle position acquisition unit 100. Similarly, the density calculation unit 101 detects that one vehicle including the vehicle 204 is present in the rear region of the vehicle 203 on the basis of the acquired position information. Also, the density calculation unit 101 calculates the front direction density Df for the vehicle 203 to be "2/3" the rear direction density Dr to be "1/3".

Then, the departure determination unit 102 calculates the front and rear direction density difference ΔD (=Df−Dr) to be "ΔD=+1/3" from the front direction density Df and the rear direction density Dr calculated by the density calculation unit 101. Thus, since the condition (ΔD≤α) that the front and rear direction density difference ΔD (=+1/3) is equal to or less than the density difference threshold value α (=0) is not satisfied, the departure determination unit 102 suspends the transmission of the departure instruction to the vehicle 203. In the example illustrated in FIG. 9A, although there are no other vehicles 201 to 20*n* stopping at a station H5, the vehicle 203 intentionally waits at the stop station H4 without proceeding to the station H5.

Then, the vehicular traffic system 1 transitions from the state illustrated in FIG. 9A to a state illustrated in FIG. 9B. Here, FIG. 9B illustrates a state immediately after the vehicle 201 has departed from the station H7 in front in the travel direction of the vehicle 203. Then, the vehicle in the front region of the vehicle 203 is only one vehicle including the vehicle 202. Thus, the density calculation unit 101 calculates the front direction density Df of the vehicle 203 to be "1/3". Subsequently, the departure determination unit 102 calculates the front and rear direction density difference ΔD (=Df−Dr) to be "ΔD=0". Thus, since the condition (ΔD≤α) that the front and rear direction density difference ΔD (=0) is equal to or less than the density difference threshold value α (=0) is satisfied, the departure determination unit 102 immediately transmits the departure instruction to the vehicle 203 (at this point, the minimum stop time Train is assumed to have elapsed). The vehicle 203 receives the departure instruction from the departure determination unit 102 and departs from the stop station H4.

According to the vehicular traffic system 1 of the present embodiment, when the operation of the vehicles 201 to 20*n* becomes nonuniform due to vehicle's trouble or the like (FIG. 9A), the operation management device 10 performs the operation management as described above, and thus, it is possible to rapidly uniformize the vehicle spacing. For example, in the case of a conventionally used operation management device, the vehicle 203 departs from the station H4 toward the station H5 according to a determined timetable even when the vehicle spacing in front of the vehicle 203 becomes short as illustrated in FIG. 9A. As a result, the vehicles 201 to 203 enter a more overcrowded state (overcrowding state), causing nonuniform provision of a transportation service. Further, once the vehicles enter such an overcrowded state, it takes time to return to normal vehicle spacing.

On the other hand, according to the vehicular traffic system 1 of the present embodiment, in the example illustrated in FIGS. 9A and 9B, the density calculation unit 101 detects a state of the density of the other vehicles 201 and 202 that are in the range of the front region of the vehicle 203. Also, if the vehicles are "dense" in the region, the departure determination unit 102 immediately suspends the departure of the vehicle 203 even though the next station is available, and thus it is possible to prevent a more overcrowded state (overcrowding state) in advance. Further, when a delay is generated in front of the vehicle 203, according to the conventional operation management device, the departure time of the vehicle 203 is adjusted on the basis of vehicle spacing with the nearest vehicle 202 in front of the vehicle 203, whereas according to the vehicular traffic system 1 of the present embodiment, the departure of the vehicle 203 is determined on the basis of departure of the vehicle 201 from the station H7, as in FIG. 9B. That is, when it is determined that the vehicles is out of the "dense" state in the front region of the vehicle 203, the departure determination unit 102 immediately transmits the departure instruction to the vehicle 203 regardless of the vehicle spacing between the vehicle 203 and the vehicle 202 traveling in a nearest position. This process implicitly involves prediction that if the vehicle spacing between the vehicle 203 and the vehicle 202 has been small, there is some room in the vehicle spacing between the vehicle 202 and the vehicle 201, and thus, the vehicle 202 will smoothly travel.

That is, when the vehicular traffic system 1 according to the present embodiment detects that the vehicles enter a "dense" state in the target vehicle 20*i* front region, the vehicular traffic system 1 immediately delays the departure and prevents a more overcrowded state (overcrowding state) in advance. Further, when it is determined that the vehicle 20*i* front region is out of the "dense" state, the target vehicle 20*i* is caused to depart without waiting for the vehicle spacing between the target vehicle 20*i* and the vehicles 201 to 20*n* traveling in a nearest position in front in the travel direction of the target vehicle 20*i* increases. Thus, the vehicular traffic system 1 according to the present embodiment determines, for the target vehicle 20*i*, the departure/stop of the target vehicle 20*i* from a step before the vehicles 201 to 20*n* enter the overcrowded state on the basis of the vehicle density in the vehicle 20*i* front region, and thus, when provision of a transportation service becomes nonuniform, it is possible to shorten the time to solve this.

Next, the effects of the operation management performed in consideration of the rear direction density Dr will be described with reference to FIGS. 10A and 10B.

FIG. 10A illustrates a state in which two vehicles including the vehicles 201 and 202 travel in the front region of the vehicle 203 and two vehicles including the vehicles 204 and 205 travel in the rear region of the vehicle 203 in the vehicular traffic system 1. Here, the front direction density Df and the rear direction density Dr of the vehicle 203 are "Df=2/3" and "Dr=2/3", respectively, and the vehicle 203 satisfies the departure condition $\Delta D \leq \alpha$ (=0). Thus, the departure determination unit 102 transmits the departure instruction to the vehicle 203 after the minimum stop time Tmin has elapsed.

Here, a delay of the departure time is assumed to occur in the vehicle 205 (which stops at the station H1) located in the rear of the vehicle 203. Then, the vehicles other than the vehicle 205 travel, and accordingly, the respective vehicles 201 to 205 enter the state illustrated in FIG. 10B. As illustrated in FIG. 10B, as a result of the delay, the vehicle 205 is out of the rear region of the vehicle 203 and only the vehicle 204 is included, and thus, the rear direction density Dr of the vehicle 203 becomes "Dr=1/3". Then, the front direction density Df and the rear direction density Dr are "Df=2/3" and "Dr=1/3", respectively, and the vehicle 203 does not satisfy the departure condition $\Delta D \leq \alpha$ (=0). Thus, the departure determination unit 102 suspends the transmission of the departure instruction to the vehicle 203 in the stop station H5.

Thus, in the example illustrated in FIGS. 10A and 10B, the vehicle 203 detects a state of the density of the other vehicles 204 and 205 that are within the range of the rear region of the vehicle 203, and immediately suspends the departure when the region is "uncrowded", thereby preventing a further uncrowded state (uncrowded state) in advance. Further, when the delay is generated in the rear of the vehicle 203, the departure time of the vehicle 203 is adjusted on the basis of the vehicle spacing between the vehicle 203 and the rear nearest vehicle 204 according to the conventional operation management device, whereas according to the vehicular traffic system 1 of the present embodiment, when the vehicle 205 arrives at the station H2 after the state of FIG. 10B, the departure of the vehicle 203 is determined regardless of the vehicle spacing between the vehicle 203 and the vehicle 204.

Thus, the vehicular traffic system 1 according to the present embodiment determines departure/stop of the target vehicle 20*i* from a step before each of the vehicles 201 to 20*n* enters a uncrowded state on the basis of the vehicle density in the vehicle 20*i* rear region for the target vehicle 20*i*, and thus, when the provision of the transportation service becomes nonuniform, it is possible to advance a time until the nonuniform provision is resolved.

Further, a case in which the preceding vehicle 201 has been out of the front region of the vehicle 203 before the vehicle 205 belongs to the vehicle 203 rear region due to the stop of the vehicle 203 in the example illustrated in FIG. 10B will be described. In this case, the front direction density Df and the rear direction density Dr for the vehicle 203 are "Df=1/3" (only one vehicle 202) and "Dr=1/3" (only one vehicle 204), respectively. Accordingly, in this case, since condition that the front and rear direction density difference $\Delta D$ is equal to or less than the density difference threshold value $\alpha$ ($\Delta D \leq \alpha$) is satisfied, the departure determination unit 102 immediately transmits the departure instruction to the vehicle 203 (at this time, the minimum stop time Tmin is assumed to elapse).

Here, in FIG. 10B, the departure determination unit 102 suspends departure of the vehicle 203 in order to prevent the rear region of the vehicle 203 from entering an uncrowded state (uncrowding state), and as a result, this time, the front region of the vehicle 203 may enter uncrowded state.

Accordingly, the departure determination unit 102 transmits a departure instruction to the vehicle 203 even when the preceding vehicle 201 is out of the front region of the vehicle 203 before the vehicle 205 belongs to the vehicle 203 rear region as described above, such that the front direction density Df and the rear direction density Dr become as uniform as possible. Thus, the departure determination unit 102 determines a transmission timing of the departure instruction on the basis of information of both of the front direction density Df and the rear direction density Dr, and thus, it is possible to more effectively suppress nonuniform provision of the transportation service.

As described above, according to the vehicular traffic system 1 of the third embodiment of the present invention, when the provision of the transportation service using vehicles becomes nonuniform, the adjustment of the departure time of each of the vehicles 201 to 20*n* is performed from a step before the vehicles enter the overcrowded state or the uncrowded state, and thus, it is possible to resolve such a state more rapidly.

Further, according to the vehicular traffic system 1, the departure time is adjusted so as to prevent each vehicle from entering the overcrowded state and the uncrowded state, and thus, for example, even when it is difficult for some vehicles to operate due to their failure, other vehicles can wait while maintaining the vehicle spacing not to enter the overcrowded state and the uncrowded state according to the stop of the failure vehicles.

Further, the examples (FIGS. 9A, 9B, 10A, and 10B) used in the above description are examples simplified for convenience of description, and application of the vehicular traffic system 1 according to the present embodiment is not limited to such examples. For example, while the density calculation unit 101 calculates the front direction density Df and the rear direction density Dr in a range corresponding to three stations in front of the target vehicle 20*i* and three stations at the rear thereof (kf=kr=3) in the above description, a wider range, for example, ten stations in front of the target vehicle and ten stations at the rear thereof (kf=kr=10), may be set in the case of a route including tens of stations. Further, the values of kf and kr may be different.

Further, while the density calculation unit 101 according to the present embodiment has calculated the front direction density Df and the rear direction density Dr using the number of vehicles present within the range corresponding to the front kf stations and the rear kr stations in the travel direction in the position in which the target vehicle 20*i* is present, the density calculation unit 101 according to another embodiment of the present invention is not limited to such an aspect. The density calculation unit 101 according to another embodiment may calculate the front direction density Df and the rear direction density Dr, for example, using the number of vehicles present within a predetermined line distance in the track 3 (for example, 10 km in front of the target vehicle 20*i* and 10 km at the rear thereof).

Similarly, the density calculation unit 101 may calculate the front direction density Df and the rear direction density Dr using the number of vehicles present within a predetermined line section divided at regular intervals in the track 3 (for example, 10 sections in front of the target vehicle 20*i* and 10 sections at the rear thereof). Thus, even when the spacing between stations installed in the track 3 is greatly nonuniform, the adjustment of the departure time can be appropriately performed on the basis of the density of the vehicles in an actual line distance or line section.

Further, the density calculation unit 101, for example, may calculate an inter-vehicle distance L from a third vehicle through counting from the nearest position in front (at the rear) in the travel direction of the target vehicle 20*i*, and calculate the front direction density Df (the rear direction density Dr) for the target vehicle 20*i* on the basis of the inter-vehicle distance L. In this case, the density calculation unit 101 may calculate, for example, the front direction density Df (the rear direction density Dr) to be "Df(Dr)=3/L".

Further, the density calculation unit 101 may obtain an inter-vehicle distance L1 from a first vehicle through counting from the nearest position in front (at the rear) in the travel direction of the target vehicle 20*i*, an inter-vehicle distance L2 from a second vehicle, and an inter-vehicle distance L3 from a third vehicle, and calculate the front direction density Df (the rear direction density Dr) to be Df(Dr)=1/L1+1/L2+1/L3. BY doing so, density comparison can be performed in consideration of the distance of each vehicle located in front and rear of the target vehicle 20*i*, and a timing of departure can be controlled in greater detail.

Further, the process of the departure determination unit 102 of the vehicular traffic system 1 according to another embodiment of the present invention is not limited to the aspect in which the departure time is adjusted on the basis of both of the front direction density Df and the rear direction density Dr. That is, while the departure determination unit 102 according to the third embodiment has adjusted the departure time at the stop station of the target vehicle 20*i* on the basis of the front and rear direction density difference ΔD (=Df−Dr), the departure determination unit 102 according to the other embodiment may adjust the departure time of the target vehicle 20*i*, for example, on the basis of only one of the front direction density Df and the rear direction density Dr.

For example, the departure determination unit 102 may adjust the departure time at the stop station of the target vehicle 20*i* on the basis of a magnitude relationship between the front direction density Df and a predetermined front direction density threshold value Dfth (Dfth is a value equal to or greater than 0). More specifically, when the front direction density Df is greater than the predetermined front direction density threshold value Dfth (Df>Dfth), the departure determination unit 102 may suspend the transmission of the departure instruction until the front direction density Df is equal to or smaller than the front direction density threshold value Dfth to delay the departure time at the stop station of the target vehicle 20*i*. Conversely, when the front direction density Df is smaller than the predetermined front direction density threshold value Dfth (Df<Dfth), the departure determination unit 102 advances a transmission time of the departure instruction until the front direction density Df is equal to or greater than the front direction density threshold value Dfth to advance the departure time at the stop station of the target vehicle 20*i*.

Similarly, the departure determination unit 102 may adjust the departure time at the stop station of the target vehicle 20*i* on the basis of a magnitude relationship between the rear direction density Dr and a predetermined rear direction density threshold value Drth (Drth is a value equal to or greater than 0). More specifically, when the rear direction density Dr is smaller than the predetermined rear direction density threshold value Drth (Dr<Drth), the departure determination unit 102 may suspend the transmission of the departure instruction until the rear direction density Dr is equal to or greater than the rear direction density threshold value Drth to delay the departure time at the stop station of the target vehicle 20*i*. Conversely, when the rear direction density Dr is greater than the predetermined rear direction density threshold value Drth (Dr>Drth), the departure determination unit 102 may advance a transmission time of the departure instruction until the rear direction density Dr is equal to or smaller than the rear direction density threshold value Drth to advance the departure time at the stop station of the target vehicle 20*i*.

Thus, even when the operation management of the respective vehicles 201 to 20*n* is performed on the basis of only any one of the front direction density Df and the rear direction density Dr, if the provision of the transportation service becomes nonuniform, an effect of advancing a time until this is resolved is obtained. Further, since information to be referred to in the operation management of the respective vehicles 201 to 20*n* is only any one of the front direction density Df and the rear direction density Dr, a load of the process in each of the vehicle position acquisition unit 100, the density calculation unit 101, and the departure determination unit 102 can be reduced.

Further, while the operation management device 10 according to the present embodiment adjusts the departure time at the stop station of the target vehicle 20*i* to obtain effects of uniformizing the vehicle spacing of the respective vehicles 201 to 20*n*, the operation management device 10 according to the present embodiment is not limited to this process when uniformizing the vehicle spacing of the respective vehicles 201 to 20*n*. For example, the operation management device 10 decreases the travel speed of the target vehicle 20*i* or stops the vehicle between stations, instead of adjusting the departure time of the stop station when uniformizing the vehicle spacing of the respective vehicles 201 to 20*n*.

Fourth Embodiment

Next, a vehicular traffic system according to a fourth embodiment of the present invention will be described. Since a functional configuration of a vehicular traffic system 1 according to the fourth embodiment is the same as that of the vehicular traffic system 1 (FIG. 6) according to the third embodiment, description thereof is omitted.

The vehicular traffic system 1 according to the fourth embodiment is different from that of the third embodiment in a process flow executed by the operation management device 10. Here, the operation management device 10 according to the third embodiment performs a process flow in which the operation management device 10 waits for the front and rear direction density difference ΔD to be equal to or smaller than the predetermined density difference threshold value α (ΔD≤α) on the basis of both pieces of information including the front direction density Df and the rear direction density Dr, and then, transmits the departure instruction to the target vehicle 20*i*, as described above. On the other hand, the departure determination unit 102 according to the fourth embodiment calculates a time for which the target vehicle 20*i* should wait at the stop station (waiting time Tw) from a value of the front and rear direction density difference ΔD calculated from the front direction density Df and the rear direction density Dr, and transmits the departure instruction when the waiting time Tw has elapsed.

The departure determination unit 102 calculates, for example, the waiting time Tw as shown in Equation (1) on the basis of the front and rear direction density difference ΔD.

[Equation 1]

$$Tw=q\cdot\Delta D(\Delta D\geq 0)$$

$$Tw=0(\Delta D)<0) \quad (1)$$

Here, the value q is a predetermined coefficient having a value equal to or greater than 0. According to Equation (1), as the front and rear direction density difference ΔD of the target vehicle 20*i* increases, that is, as the front is "denser" than the rear, the waiting time Tw of the target vehicle 20*i* increases. Thus, when density of the other vehicles 201 to 20*n* is small before and after the target vehicle 20*i*, the waiting time Tw is set to be small, and when the density of the other vehicles 201 to 20*n* is great, the waiting time Tw is accordingly set to be great. Accordingly, the effect of solving the nonuniformity of the operation of vehicles 201 to 20*n* is obtained. Further, when the front and rear direction density difference ΔD is smaller than 0 (that is, when the rear is "denser" than the front), the waiting is not performed (Tw=0). For the coefficient q, an optimal constant obtained from, for example, an empirical rule or a simulation result may be selected.

Further, the coefficient q may be, for example, a variable based on a "front inter-vehicle distance Lf" and a "rear inter-vehicle distance Lr" of the target vehicle 20*i*. Here, the "front inter-vehicle distance Lf" is an inter-vehicle distance between the target vehicle 20*i* and the other vehicles 201 to 20*n* traveling in the nearest position in front in the travel direction of the target vehicle 20*i*. The "rear inter-vehicle distance Lr" is an inter-vehicle distance between the target vehicle 20*i* and other vehicles 201 to 20*n* traveling in the nearest position at the rear in the travel direction of the target vehicle 20*i*. In this case, the departure determination unit 102 may calculate the coefficient q as shown in Equation (2) on the basis of the front inter-vehicle distance Lf and the rear inter-vehicle distance Lr.

[Equation 2]

$$q=q'\cdot(Lf-Lr)(Lf-Lr\geq 0)$$

$$q=0(Lf-Lr<0) \quad (2)$$

Here, the value q' is a predetermined coefficient having a value equal to or greater than 0. According to Equation (2), as the front inter-vehicle distance Lf is greater than the rear inter-vehicle distance Lr, the value of the coefficient q tends to increase and the waiting time Tw tends to increase. Conversely, when the front inter-vehicle distance Lf is smaller than the rear inter-vehicle distance Lr, the value of the coefficient q tends to decrease and the waiting time Tw tends to decrease. Further, when the rear inter-vehicle distance Lr is greater than the front inter-vehicle distance Lf, the coefficient q is set to 0 and, in this case, waiting is not performed (Tw=0). Effects of the process in which the departure determination unit 102 determines the waiting time Tw of the target vehicle 20*i* according to such an algorithm will be described below.

(Process Flow of Operation Management Device According to Fourth Embodiment)

Figure 11:
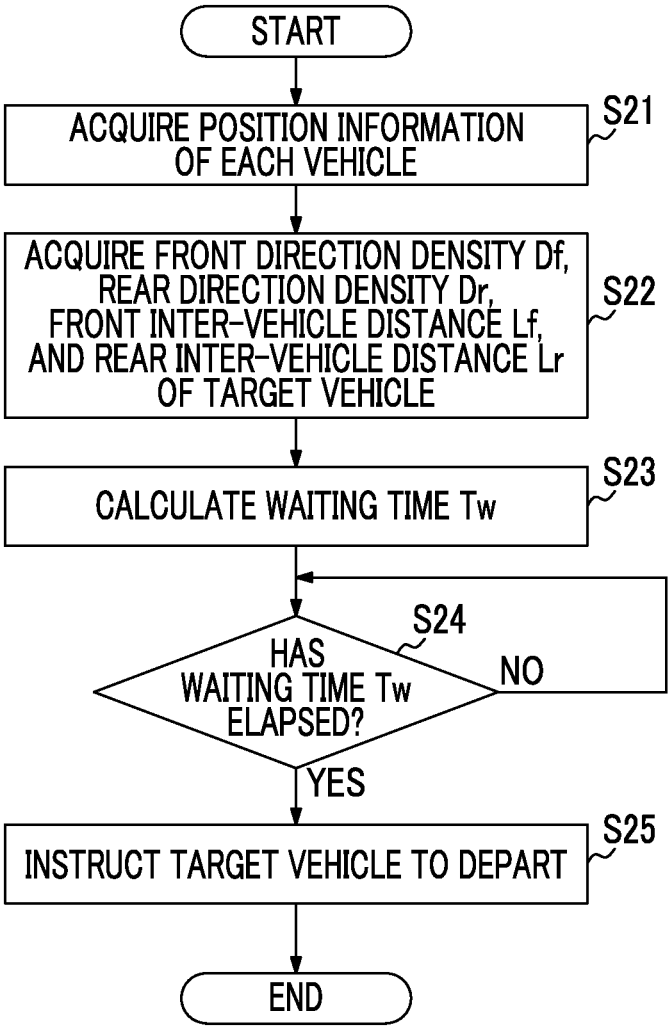
FIG. 11 is a flowchart illustrating a process flow of an operation management device according to a fourth embodiment of the present invention.

FIG. 11 is a flowchart illustrating a process flow of the operation management device according to the fourth embodiment of the present invention.

The operation management device 10 according to the present embodiment executes the process flow (FIG. 11) to be described below. Further, the process flow of FIG. 11 is a process flow until the departure instruction is transmitted to the target vehicle 20*i* which stops at a predetermined station.

First, the vehicle position acquisition unit 100 of the operation management device 10 acquires the position information of each of the vehicles 201 to 20*n* traveling along the track 3 (step S21).

Then, the density calculation unit 101 calculates the front direction density Df and the rear direction density Dr of the target vehicle 20*i* on the basis of the position information of each of the vehicles 201 to 20*n* acquired in step S21. Further, the density calculation unit 101 acquires the front inter-vehicle distance Lf and the rear inter-vehicle distance Lr of the target vehicle 20*i* (step S22). Also, the departure determination unit 102 calculates the front and rear direction density difference ΔD on the basis of the front direction density Df and the rear direction density Dr calculated in step S22, and calculates the coefficient q (Equation (2)) on the basis of the front inter-vehicle distance Lf and the rear inter-vehicle distance Lr. Also, the departure determination unit 102 calculates the waiting time Tw on the basis of Equation (1) (step S23). Here, when the calculated waiting time Tw is less than the minimum stop time Tmin determined to ensure the time taken for a passenger to get on or off, the departure determination unit 102 sets the minimum stop time Tmin to the waiting time Tw.

Then, the departure determination unit 102 first determines whether the waiting time Tw has elapsed after the target vehicle 20*i* arrives at the stop station (step S24). Here, when the waiting time Tw has not elapsed ("NO" in step S24), the process does not proceed to the next step until the waiting time Tw elapses. When the waiting time Tw has elapsed ("YES" in step S24), the departure determination unit 102 transmits the departure instruction to the target vehicle 20*i* (step S25).

The operation management device 10 executes the above-described process flow to realize a process in which the departure instruction is transmitted to the target vehicle 20*i* at a time at which the waiting time Tw obtained using a predetermined calculation equation on the basis of the front and rear direction density difference ΔD, the front inter-vehicle distance Lf, and the rear inter-vehicle distance Lr has elapsed.

According to the process flow (FIG. 11) as described above, the operation management device 10 performs the acquisition of the position information of the vehicles 201 to 20*n* (step S21) and the calculation of various parameters (Df, Dr, Lf, and Lr) (step S22), and then, waits for the waiting time Tw calculated according to these. Accordingly, the operation management device 10 according to the present embodiment may perform, once, a process of the acquisition of the position information of the vehicles 201 to 20*n* in the vehicle position acquisition unit 100 and the calculation of the various parameters (Df, Dr, Lf, and Lr) in the density calculation unit 101 in the process of adjusting the departure time of the target vehicle 20*i*. Accordingly, the repeated acquisition of the position information and the repeated calculation of the various parameters (Df and Dr) (FIG. 8) are not performed unlike the operation management device according to the third embodiment, and thus, it is possible to reduce a processing load of the operation management device 10 as compared to the third embodiment.

(Effects of Operation Management Device According to Fourth Embodiment)

Figure 12:
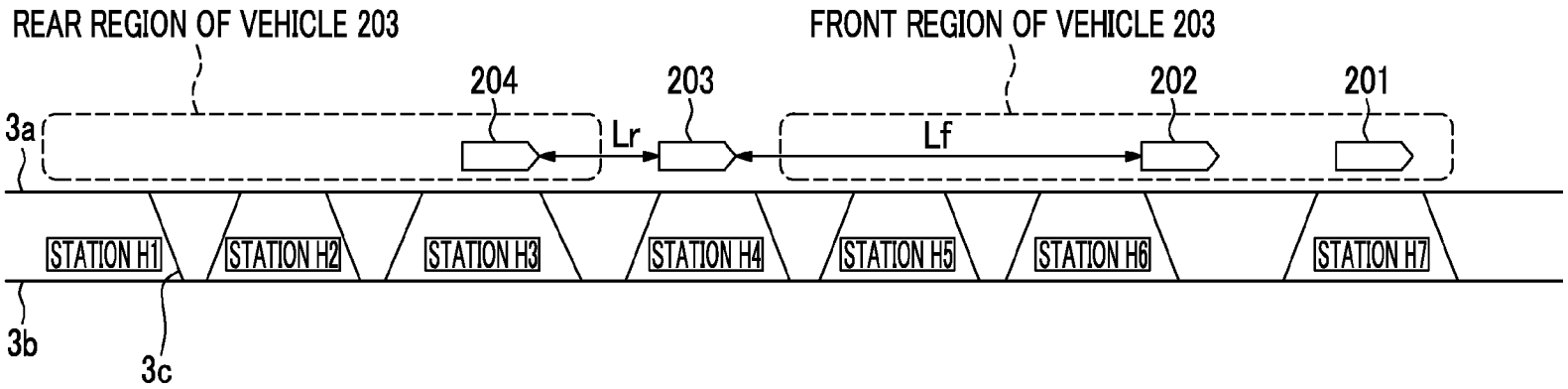
FIG. 12 is a diagram illustrating effects of a vehicular traffic system according to the fourth embodiment of the present invention.

FIG. 12 is a diagram illustrating effects of the vehicular traffic system according to the fourth embodiment of the present invention. Here, vehicles 201 to 204 illustrated in FIG. 12 are vehicles that travel along a first track 3*a* from the left of a paper surface to the right. Further, in the example described with reference to FIG. 12, the example is focused on an operation of the vehicle 203 as a target vehicle 20*i*, and it is assumed that kf=kr=3 is set, similarly to the example illustrated in FIGS. 7, 9A, 9B, 10A, and 10B.

Effects of the operation management performed in consideration of the front inter-vehicle distance Lf and the rear inter-vehicle distance Lr will be described with reference to FIG. 12.

As illustrated in FIG. 12, for the vehicle 203 stop at a station H4, two vehicles including the vehicle 201 and the vehicle 202 are present in a front region of the vehicle 203. Further, vehicle spacing therebetween is smaller than normal vehicle spacing. Further, as illustrated in FIG. 12, an inter-vehicle distance between the vehicle 202 and the vehicle 203 is great, and a front inter-vehicle distance Lf that is a distance between the vehicle 203 and the nearest vehicle 202 in front in the travel direction of the vehicle 203 is relatively great. On the other hand, only one vehicle including a vehicle 204 is present in a rear region of the vehicle 203. Further, as illustrated in FIG. 12, the vehicle spacing between the vehicle 204 and the vehicle 203 is small, and a rear inter-vehicle distance Lr that is a distance between the vehicle 203 and the nearest vehicle 204 at the rear in the travel direction of the vehicle 203 is smaller than the front inter-vehicle distance Lf (Lf−Lr<0).

Here, when the departure determination unit 102 simply calculates the waiting time Tw on the basis of only the front direction density Df and the rear direction density Dr of the vehicle 203, the front and rear direction density difference ΔD has a positive value in the state illustrated in FIG. 12, and thus, the vehicle 203 waits for a predetermined waiting time Tw at the station H4 (Equation (1)). However, in the case of FIG. 12, in fact, the front inter-vehicle distance Lf of the vehicle 203 is greater than the rear inter-vehicle distance Lr, and the vehicle 203 rather enters a state in which vehicle spacing between the vehicle 203 and the rear vehicle 204 is small. In such a state, when the waiting time Tw is generated for the vehicle 203, a more overcrowded state (overcrowding state) may be caused at the rear of the vehicle 203. Therefore, in such a case, it is preferable to rapidly cause the vehicle 203 to depart by setting the waiting time Tw to 0 even when the front direction density Df is high. That is, the operation management device 10 according to the present embodiment can select an appropriate operation even when the vehicle spacing between the vehicle 203 and the nearest vehicle in front in the travel direction of the vehicle 203 is great despite the high front direction density Df.

Thus, when the waiting time Tw is calculated, the waiting time Tw is weighted according to not only the front direction density Df and the rear direction density Dr, but also the rear inter-vehicle distance Lr and the front inter-vehicle distance Lf. Thus, when provision of a transportation service is nonuniform, the waiting time is determined more accurately. Accordingly, it is possible to rapidly uniformize the provision of the transportation service.

Fifth Embodiment

Next, a vehicular traffic system according to a fifth embodiment of the present invention will be described.

Figure 13:
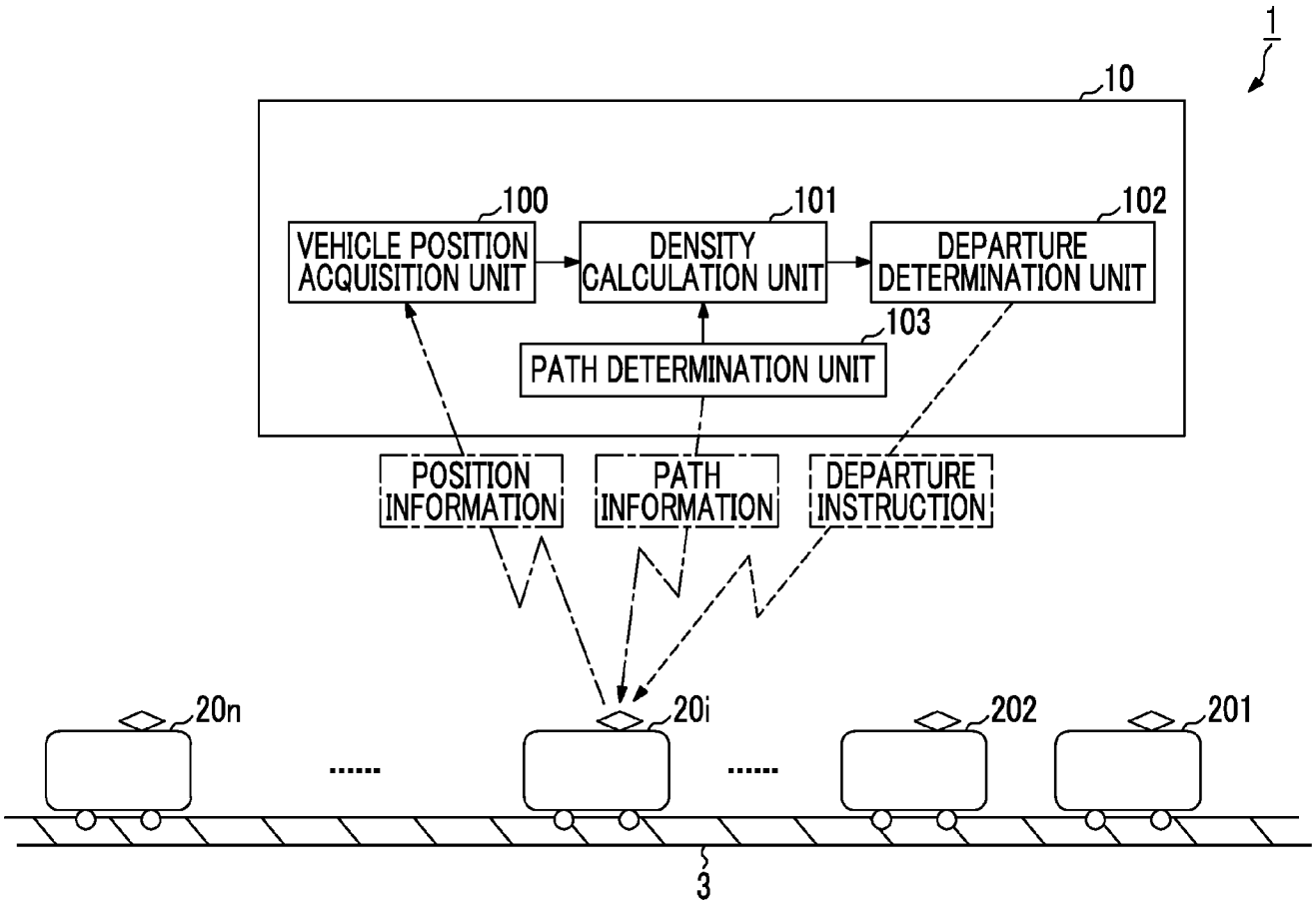
FIG. 13 is a diagram illustrating a functional configuration of a vehicular traffic system according to a fifth embodiment of the present invention.

FIG. 13 is a diagram illustrating a functional configuration of a vehicular traffic system according to the fifth embodiment of the present invention. Among functional components of a vehicular traffic system 1 according to the fifth embodiment, the same functional components as those of the vehicular traffic system 1 according to the third embodiment (FIG. 6) are denoted with the same reference signs, and description thereof is omitted.

As illustrated in FIG. 13, the operation management device 10 of the vehicular traffic system 1 according to the present embodiment is configured to further include a path determination unit 103, in addition to the functional components of the vehicular traffic system 1 according to the third embodiment. Here, the path determination unit 103 is a functional unit that designates a travel path on the track 3 for each of the vehicles 201 to 20*n*. The path determination unit 103 transmits predetermined path information to each of the vehicles 201 to 20*n* according to operation situation. When the vehicles 201 to 20*n* receive the path information, the vehicles 201 to 20*n* select a path specified in the path information and travel along the path. Further, the path determination unit 103 also outputs the same path information to the density calculation unit 101. For example, the density calculation unit 101 receiving the path information transmitted to the predetermined target vehicle 20*i* sets the vehicle 20*i* front region and the vehicle 20*i* rear region on the basis of the travel path designated in the path information. Also, the density calculation unit 101 calculates the front direction density Df on the basis of the vehicle 20*i* front region set here and the rear direction density Dr on the basis of the vehicle 20*i* rear region. By doing so, when the travel path of the target vehicle 20*i* is changed by the path determination unit 103, the density calculation unit 101 can calculate the front direction density Df and the rear direction density Dr for the target vehicle 20*i* on the basis of the travel path set newly each time.

Further, the vehicle position acquisition unit 100 according to the present embodiment has a function of acquiring a travel direction of the plurality of vehicles 201 to 20*n*. Specifically, the vehicle position acquisition unit 100 first detects transition of the position of the vehicles 201 to 20*n* indicated by the position information received from the vehicles 201 to 20*n*. Further, the vehicle position acquisition unit 100 determines the travel direction of the vehicles 201 to 20*n* to be, for example, "up" or "down" from the transition of the position of the vehicles 201 to 20*n* in the path by referring to the path information of each of the vehicles 201 to 20*n* from the path determination unit 103. Further, means with which the vehicle position acquisition unit 100 acquires the travel direction of the vehicles 201 to 20*n* is not limited to the above-described means, and may be any means as long as there is an effect of obtaining travel direction information of the vehicles 201 to 20*n*.

Figure 14A:
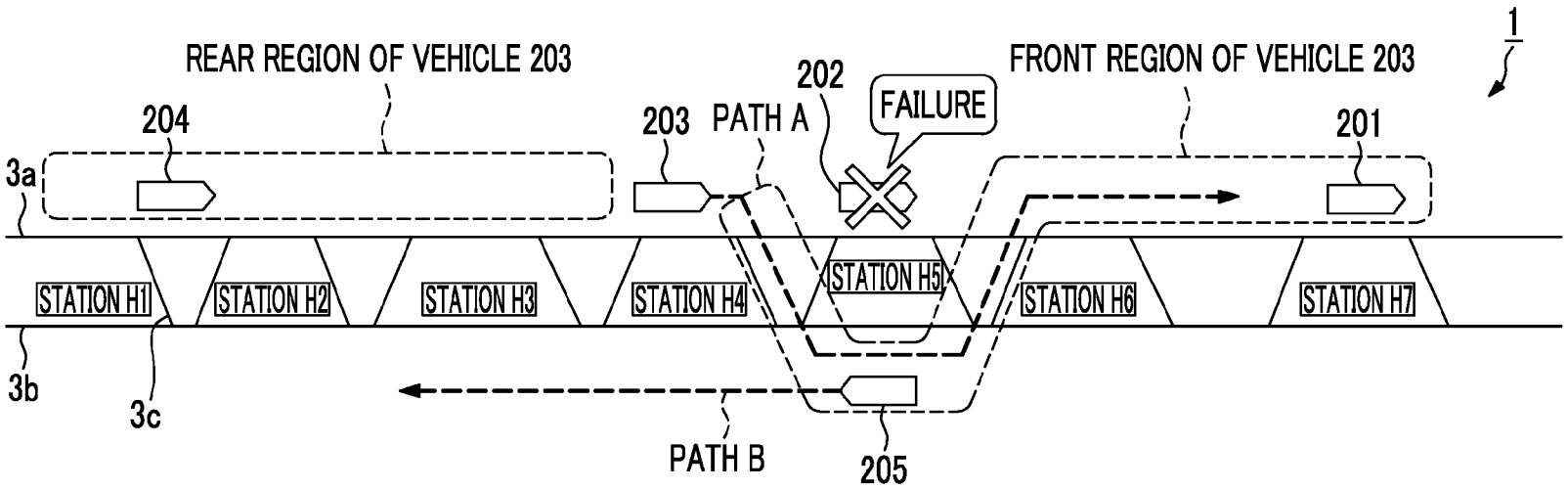
FIG. 14A is a first diagram illustrating effects of the vehicular traffic system according to the fifth embodiment of the present invention.
Figure 14B:
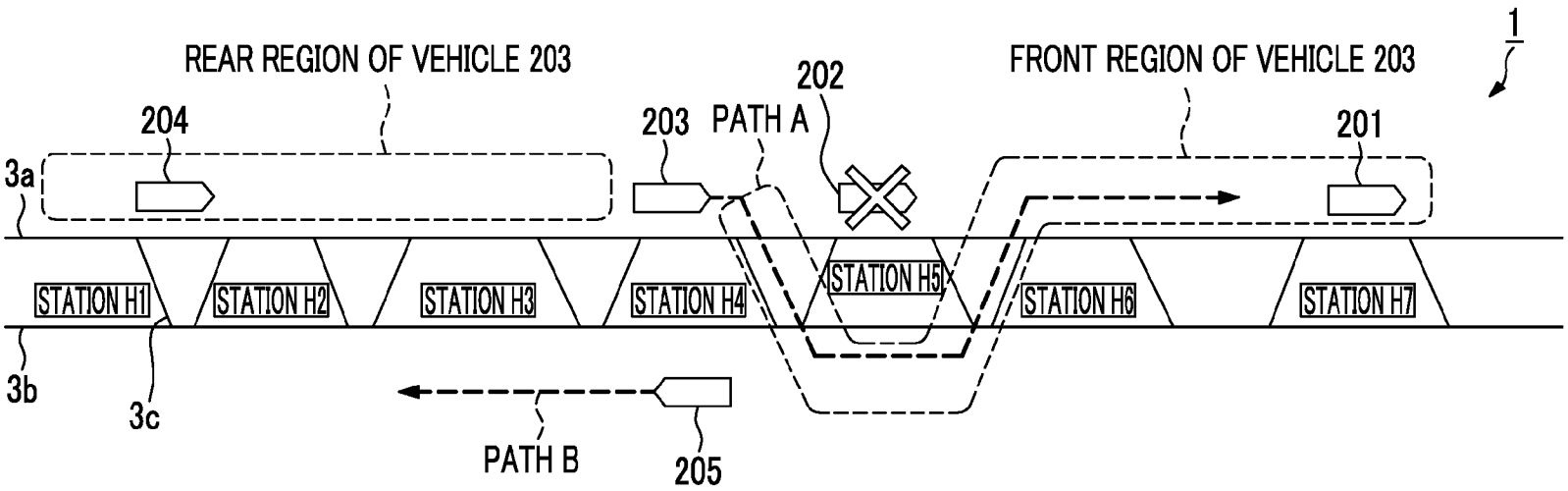
FIG. 14B is a second diagram illustrating effects of the vehicular traffic system according to the fifth embodiment of the present invention.

FIGS. 14A and 14B are first and second diagrams illustrating effects of a vehicular traffic system according to the fifth embodiment of the present invention. Further, vehicles 201 to 204 illustrated in FIGS. 14A and 14B are vehicles traveling along a first track 3*a* from the left of a paper surface to the right. On the other hand, a vehicle 205 is a vehicle traveling along a second track 3*b* different from the first track 3*a* from the right of the paper surface to the left. Further, in an example to be described with reference to FIGS. 14A and 14B, the example is focused on an operation of the vehicle 203 as a target vehicle 20*i*, and it is assumed that kf=kr=3 and $\alpha$=0 are set, similarly to the example illustrated in FIG. 7 or the like. Further, the process flow of the operation management device 10 according to the fifth embodiment is assumed to be the same as the process flow (FIG. 8) in the third embodiment.

Effects of the operation management performed in consideration of the change in the path will be described with reference to FIGS. 14A and 14B.

As illustrated in FIG. 14A, two vehicles including a vehicle 201 stopping at a station H7 on a first track 3*a* and a vehicle 202 stopping at a station H5 are present in front in a travel direction of the vehicle 203 stop at a station H4. Further, only one vehicle including a vehicle 204 is present at the rear in the travel direction of the vehicle 203 (in a rear region of vehicle 203). Further, the vehicle 205 traveling along the second track 3*b* in a direction opposite to the vehicle 203 stops at the station H5 in front in the travel direction of the vehicle 203.

As illustrated in FIG. 14A, the nearest vehicle 202 in front in the travel direction of the vehicle 203 is assumed to have been unable to operate at the station H5 due to vehicle failure. Then, the vehicle 203 is unable to pass through a path on the first track 3*a* that has been set initially. Here, the path determination unit 103 transmits path information indicating a new path (path A) to the vehicle 203 so that the vehicle 203 continues to operate. Here, the path determination unit 103 sets, for example, a path (path A) for passing through the branch road 3*c* between the station H4 and the station H5 to enter the second track 3*b* and passing through the branch road 3*c* between the station H5 and the station H6 to return to the first track 3*a*, as illustrated in FIG. 14A. That is, the path determination unit 103 transmits, to the vehicle 203, the path information indicating the path (path A) that bypasses the vehicle 202 that is unable to operate due to failure.

Then, the path determination unit 103 also outputs the path information indicating the same path (path A) to the density calculation unit 101. When the density calculation unit 101 receives the path information, the density calculation unit 101 detects that the path of the vehicle 203 has been changed. Also, the density calculation unit 101 resets the front region of the vehicle 203 for the path that has been newly set for the vehicle 203. Here, the front region of the vehicle 203 is reset according to the newly set path A. That is, the front region of the vehicle 203 is a range corresponding to three stations in front in the travel direction along the path for passing through the branch road 3*c* between the station H4 and the station H5 to enter the second track 3*b* and passing through the branch road 3*c* between the station H5 and the station H6 to return to the first track 3*a*, as illustrated in FIG. 14A.

When the density calculation unit 101 resets the front region of the vehicle 203, the density calculation unit 101 immediately calculates the front direction density Df on the basis of the newly set front region of the vehicle 203. Here, the vehicle 201 stopping at the station H7 and the vehicle 205 traveling along the second track 3*b* are included in the reset front region of the vehicle 203, as illustrated in FIG. 14A. Accordingly, the density calculation unit 101 calculates the front direction density Df to be "2/3". In this case, since the rear direction density Dr is "1/3," the vehicle 203 waits at the station H4.

Next, it is assumed that the vehicle 205 departs from the station H5 and travels toward the station H4 along a path B, as illustrated in FIG. 14B. Then, the vehicle 205 is out of the front region of the vehicle 203, and only the vehicle 201 belongs to the front region of the vehicle 203. As a result, the front direction density Df becomes 1/3, and the vehicle 203 resumes the operation along the path A.

Thus, the path determination unit 103 according to the present embodiment sequentially outputs the path information indicating the changed path to the density calculation unit 101, and thus, the density calculation unit 101 can calculate the front direction density Df for the newly selected path. Accordingly, even when the change of the path is instructed, the departure time of each of the vehicles 201 to 20*n* is adjusted so that the vehicle spacing is uniform on the basis of the front direction density Df and the rear direction density Dr that have been newly calculated.

Further, the vehicular traffic system 1 according to the present embodiment may further have the following functions.

Specifically, the vehicle position acquisition unit 100 acquires position information of the plurality of vehicles 201 to 20*n* and acquires travel direction information indicating a travel direction of each of the vehicles 201 to 20*n*. Also, the density calculation unit 101 receives the travel direction information, and determines whether there is a vehicle traveling in a direction opposite to the travel direction of the target vehicle 20*i* in front in the travel direction of the track 3 along which the target vehicle 20*i* travels. Also, when it is determined that there is a vehicle traveling in a direction opposite to the travel direction of the target vehicle 20*i*, the operation management device 10 performs a predetermined correction process of increasing the front direction density Df for the target vehicle 20*i*. Here, in the example of FIGS. 14A and 14B, the target vehicle 20*i* is a vehicle 203, and the "vehicle traveling in a direction opposite to the travel direction of the target vehicle 20*i*" is a vehicle 205.

Here, the case in which the vehicle 205 travels along the path B and is out of the front region of the vehicle 203 while the vehicle 203 is stopping at the station H4, and as a result, the front direction density Df of the vehicles 203 decreases and the vehicle 203 can depart from the station H4 in the example illustrated in FIGS. 14A and 14B has been described. However, in the example illustrated in FIG. 14A, in addition to the above description, the front direction density Df of the vehicle 203 decreases and the vehicle 203 can depart from the station H4 even when the vehicle 201 departs from the station H7 before the vehicle 205 departs from the station H5. In this case, since the vehicle 205 traveling in an opposite direction is present in front in the travel direction of the vehicle 203, it is dangerous for the vehicle 203 to directly start the operation, and this should be prevented from the beginning.

Therefore, when it is determined that there is the vehicle 205 traveling in a direction opposite to the travel direction of the vehicle 203, the density calculation unit 101 according to the present embodiment performs a correction to increase the front direction density Df. That is, the density calculation unit 101 performs a correction process such that a count of the number of vehicles for the vehicle 205 is greater than 1. In the example of FIGS. 14A and 14B, for example, the density calculation unit 101 performs the correction process in which four vehicles rather than one vehicle are regarded as being present for the vehicle 205 traveling in the opposite direction of the vehicle 203, and performs calculation of the front direction density Df. Thus, the front direction density Df is calculated to be at least Df=4/3 as long as there is one vehicle 205. That is, as long as there is the vehicle 205, the vehicle 203 does not depart from the station H4 if the rear direction density Dr is not 4/3 or more. Further, in the above-described correction process (for example, the process of regarding one vehicle as four vehicles), the front direction density Df calculated after the correction (for example, Df=4/3) is set to a value at which the rear direction density Dr is not equal to or greater than such a value in terms of the operation management of the vehicular traffic system 1. Thus, in the state illustrated in FIG. 14A, even when the vehicle 201 has departed the station H7 toward the front station (a station H8 that is not illustrated) earlier than the vehicle 205, the vehicle 203 actually waits at the station H4 until the vehicle 205 departs from the station H5 along the path B.

Thus, the vehicular traffic system 1 according to the present embodiment enables change of a dynamic path according to a change in an operation situation due to unexpected vehicle failure or the like, and can provide a more secure transportation service.

Figure 15A:
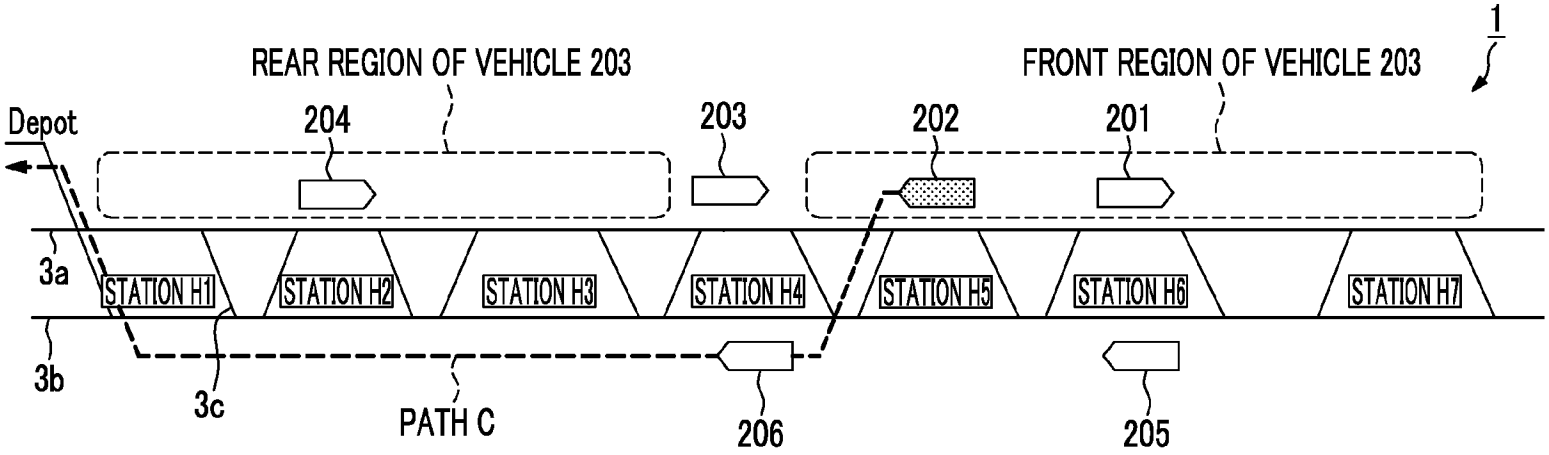
FIG. 15A is a third diagram illustrating effects of the vehicular traffic system according to the fifth embodiment of the present invention.
Figure 15B:
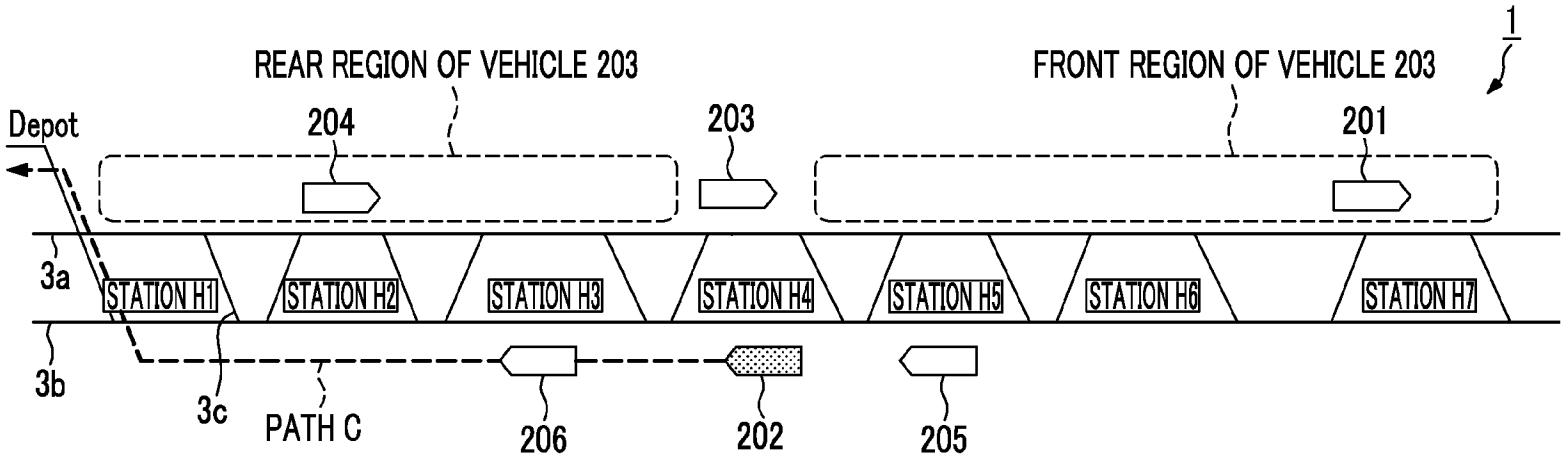
FIG. 15B is a fourth diagram illustrating effects of the vehicular traffic system according to the fifth embodiment of the present invention.

FIGS. 15A and 15B are third and fourth diagrams illustrating effects of the vehicular traffic system according to the fifth embodiment of the present invention. Further, vehicles 201 and 203 to 204 illustrated in FIGS. 15A and 15B are vehicles that travel along a first track 3*a* from the left of a paper surface to the right. On the other hand, vehicles 205 and 206 are vehicles that travel along a second track 3*b* different from the first track 3*a* from the right of the paper surface to the left. Further, in an example described with reference to FIGS. 15A and 15B, the example is focused on an operation of the vehicle 203 as a target vehicle 20*i*, and it is assumed that kf=kr=3 and $\alpha$=0 are set, similarly to the example illustrated in FIG. 7 or the like. Further, a process flow of the operation management device 10 according to the fifth embodiment is assumed to be the same as the process flow (FIG. 8) in the third embodiment.

According to the vehicular traffic system 1 of the fifth embodiment, it is possible to further cope with the following situation.

In an example illustrated in FIG. 15A, for a vehicle 203 stopping at a station H4, two vehicles including a vehicle 201 stopping at a station H7 on a first track 3*a* and a vehicle 202 stopping at a station H5 are present in a front region of the vehicle 203. Further, only one vehicle including a vehicle 204 is present in a rear region of the vehicle 203. Further, a vehicle 206 and a vehicle 205 traveling along a second track 3*b* in an opposite direction of the vehicle 203 stop at a station H4 and a station H6, respectively.

In FIG. 15A, the vehicle 202 is a vehicle traveling along the first track 3*a* in the same direction as the vehicle 203, but it is assumed here that the path determination unit 103 resets a path (path C) for withdrawing the vehicle 202 to a vehicle depot (FIGS. 15A and 15B). Then, in a step of FIG. 15A, the vehicle 202 traveling in an opposite direction is present in a front region of the vehicle 203, and thus, when the front direction density Df is calculated, a correction process to increase the front direction density Df (for example, a process of regarding one vehicle 202 as four vehicles) is performed, and the vehicle 203 waits at the station H4 until the vehicle 202 is out of the front region of the vehicle 203. Further, the vehicle 204 similarly waits at the station H2 until the vehicle 202 is out of a front region (not illustrated) of the vehicle 204.

The vehicle 202 then travels to the station H4 along the second track 3*b*, as illustrated in FIG. 15B.

Then, the density calculation unit 101 detects that the front direction density Df decreases due to the vehicle 202 being out of the front region of the vehicle 203, and the departure determination unit 102 transmits the departure instruction to the vehicle 203. Meanwhile, the vehicles 205 and 206 traveling along the second track 3*b* travel to the station H5 and the station H3, respectively. However, the vehicle 202 enters the second track 3*b* to be between the vehicle 205 and the vehicle 206, as illustrated in FIG. 15B. Then, the front direction density Df of the vehicle 205 suddenly increases. As a result, the vehicle 205 waits at the station H5 until the front direction density Df decreases.

When there is a vehicle that suddenly turns back to the depot, it is necessary to recreate a timetable for all vehicles in the related art, whereas according to the vehicular traffic system 1 of the present embodiment, if only a vehicle turning back to the depot and its path are designated, vehicle spacing between the vehicle and the other vehicle is automatically adjusted. Accordingly, an effect of reducing an effort when the vehicle turns back to the depot is obtained.

Further, while the vehicular traffic systems 1 according to the third to fifth embodiments described above have all been described as the aspect in which the single ground facility, that is, the operation management device 10 controls the operation of all the vehicles 201 to 20*n*, the vehicular traffic system 1 according to another embodiment of the present invention is not limited to such an aspect. For example, the vehicular traffic system 1 according to the other embodiment may be an aspect in which a plurality of different operation management devices 10 are included as ground facilities. Also, for example, the vehicular traffic system 1 may be an aspect in which the respective operation management devices 10 assigned to respective predetermined sections of the track 3 may control the operations of the vehicles 201 to 20*n* traveling in the predetermined section.

Sixth Embodiment

Next, a vehicular traffic system according to a sixth embodiment of the present invention will be described.

Figure 16:
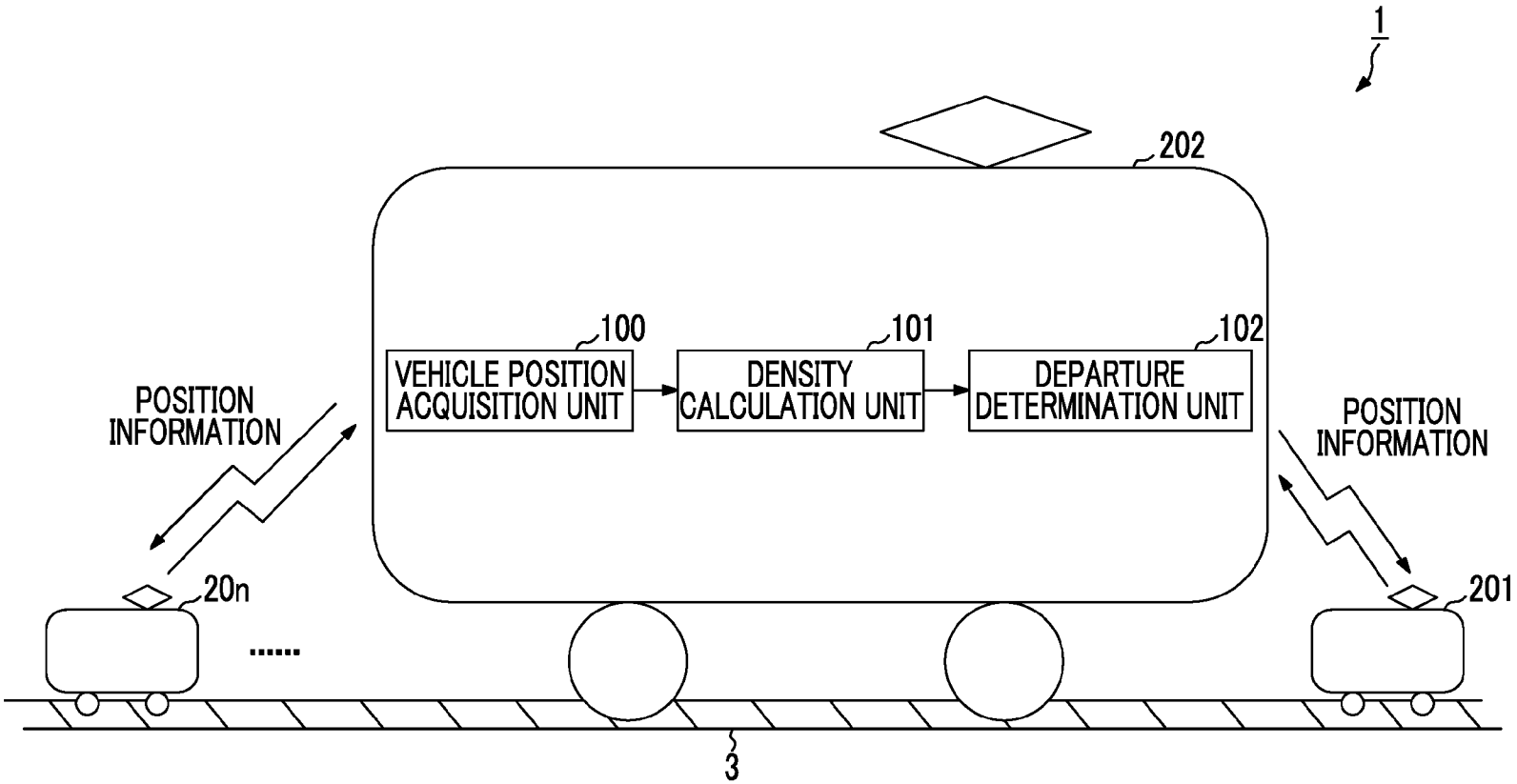
FIG. 16 is a diagram illustrating a functional configuration of a vehicular traffic system according to a sixth embodiment of the present invention.

FIG. 16 is a diagram illustrating a functional configuration of a vehicular traffic system according to the sixth embodiment of the present invention. Further, among the functional components of a vehicular traffic system 1 according to the sixth embodiment, the same functional components as those in the vehicular traffic system 1 according to the third embodiment (FIG. 6) are denoted with the same reference signs, and description thereof is omitted.

The vehicular traffic system 1 according to the sixth embodiment of the present invention does not include the operation management device 10 that is a ground facility in the third to fifth embodiments. Also, each of the vehicles 201 to 20*n* includes the vehicle position acquisition unit 100, the density calculation unit 101, and the departure determination unit 102 included in the operation management device 10 in the third to fifth embodiments (while the functional components of only the vehicle 202 are described in FIG. 16 for convenience, each of the vehicles 201 to 20*n* includes the same functional components as the vehicle 202).

Here, according to the vehicular traffic system 1 of the present embodiment, each of the vehicles 201 to 20*n* can autonomously adjust the vehicle spacing while communicating with the other vehicles 201 to 20*n*. Specifically, the vehicle position acquisition units 100 of the vehicles 201 to 20*n* communicate with each other and acquire the position information for the respective vehicles 201 to 20*n* (step S11 in FIG. 8). Then, the density calculation units 101 provided in the respective vehicles 201 to 20*n* calculate the front direction density Df and the rear direction density Dr of the own vehicles on the basis of the position information of the respective vehicles 201 to 20*n* (step S12 in FIG. 8). Also, the departure determination units 102 provided in the respective vehicles 201 to 20*n* perform a determination of departure instruction or departure suspending for the own vehicle on the basis of the front direction density Df and the rear direction density Dr for the own vehicle (steps S13 and S14 in FIG. 8).

As described above, according to the vehicular traffic system 1 of the present embodiment, the respective vehicles 201 to 20*n* can recognize a positional relationship among them and autonomously operate while adjusting the vehicle spacing between the own vehicle and the other vehicle on the basis of the densities of the vehicles in front and at the rear. Accordingly, it is not necessary to perform an operation using a ground facility (operation management device 10) that centrally manages the entire operation of the vehicles 201 to 20*n*, and it is possible to achieve distribution of an operation management process. If the distribution of the operation management process is made in this way, influence on an operation of the vehicular traffic system 1 is minimized even when any of each operation management system (the vehicles 201 to 20*n* in the present embodiment) fails. Accordingly, it is possible to improve reliability of the entire vehicular traffic system 1.

Further, each of the vehicles 201 to 20*n* of the vehicular traffic system 1 according to the sixth embodiment of the present invention may further include the function (operation control based on the front inter-vehicle distance Lf and the rear inter-vehicle distance Lr) described in the fourth embodiment or the function (dynamic path changing process in the path determination unit 103) described in the fifth embodiment.

Further, the vehicular traffic system 1 according to the third to sixth embodiments described above may further include a passenger information system (PIS) as a ground facility. A conventional PIS displays a scheduled arrival time of a vehicle on a screen provided at a station on the basis of a predetermined timetable, whereas in the case of the vehicular traffic system 1 according to the present embodiment, since an operation that does not use the timetable is performed, an arrival vehicle and an arrival time cannot be recognized on the basis of only the timetable information. Therefore, the PIS according to the present embodiment performs a process of receiving identification information, position information, and path information of the target vehicle 20*i* from the operation management device 10 (each of the vehicles 201 to 20*n* in the case of the sixth embodiment), calculating a scheduled arrival time for each station of the target vehicle 20*i*, and displaying the calculated scheduled arrival time on a display screen installed in each station. Here, the identification information of the target vehicle 20*i* may be, for example, a unique ID (IDentification) number that can specify the target vehicle 20*i*. After specifying the target vehicle 20*i* from the identification information, the PIS according to the present embodiment can easily estimate a time required until at least the next stop station from, for example, a travel speed of the target vehicle 20*i* when the position information and the path information can be recognized.

Further, the PIS of the present embodiment may further calculate various parameters such as the front direction density from Df, the rear direction density Dr, the front inter-vehicle distance Lf, and the rear inter-vehicle distance Lr using the density calculation unit 101, and estimate the scheduled arrival time of the target vehicle 20*i* on the basis of the parameters. Specifically, the PIS according to the present embodiment performs a process of calculating the waiting time T of the target vehicle 20*i* obtained using calculation equations in Equations (1) and (2) to estimate the scheduled arrival time at each station. By doing so, the passenger of the vehicular traffic system 1 can recognize the scheduled arrival time of the vehicles 201 to 20*n* that arrive at the station even when the respective vehicles 201 to 20*n* do not travel on the basis of the timetable.

Each time various parameters such as the front direction density Df and the rear direction density Dr for the target vehicle 20*i* have changed according to the operating situation, the PIS according to the present embodiment may receive the respective parameters from the density calculation unit 101 and calculate a new scheduled arrival time. By doing so, the vehicular traffic system 1 can dynamically correspond to the operation situation of each of the vehicles 201 to 20*n* and provide the passengers with a more accurate scheduled arrival time.

Figure 17:
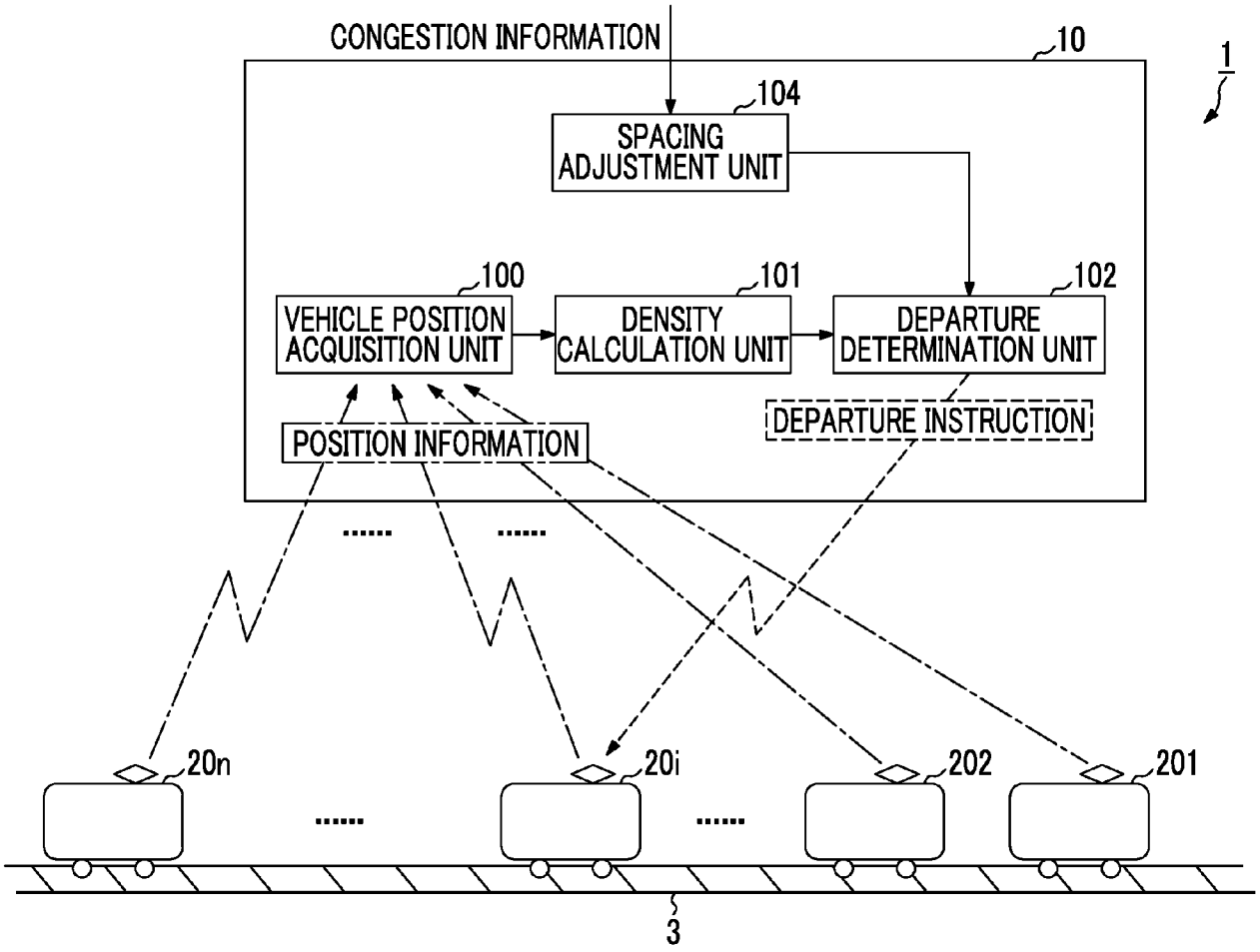
FIG. 17 is a diagram illustrating a functional configuration of a vehicular traffic system according to a seventh embodiment of the present invention.

FIG. 17 is a diagram illustrating a functional configuration of a vehicular traffic system according to a seventh embodiment of the present invention. Further, FIG. 18 is a diagram illustrating a functional configuration of a vehicular traffic system according to an eighth embodiment of the present invention.

As illustrated in FIG. 17, the operation management device 10 according to the seventh embodiment of the present invention may include both of the function of the spacing adjustment unit 104 according to the first embodiment and the function of the density calculation unit 101 according to the third embodiment described above. Further, in this case, the departure determination unit 102 of the operation management device 10 according to the present embodiment may include both of the function of the departure determination unit 102 according to the first embodiment and the function of the departure determination unit 102 according to the third embodiment.

Further, if the operation management device 10 has the functions of both of the first embodiment and the fifth embodiment, when the functions of the density calculation unit 101 and the departure determination unit 102 according to the third embodiment are valid, the functions of the spacing adjustment unit 104 and the departure determination unit 102 according to the first embodiment may be invalid. Similarly, when the functions of the spacing adjustment unit 104 and the departure determination unit 102 according to the first embodiment are valid, the functions of the density calculation unit 101 and the departure determination unit 102 according to the third embodiment may be invalid. In this way, the operation management device 10 can perform the operation while appropriately selecting the function of uniformizing the vehicle spacing according to the third embodiment and the function of changing the vehicle density according to the first embodiment.

Figure 18:
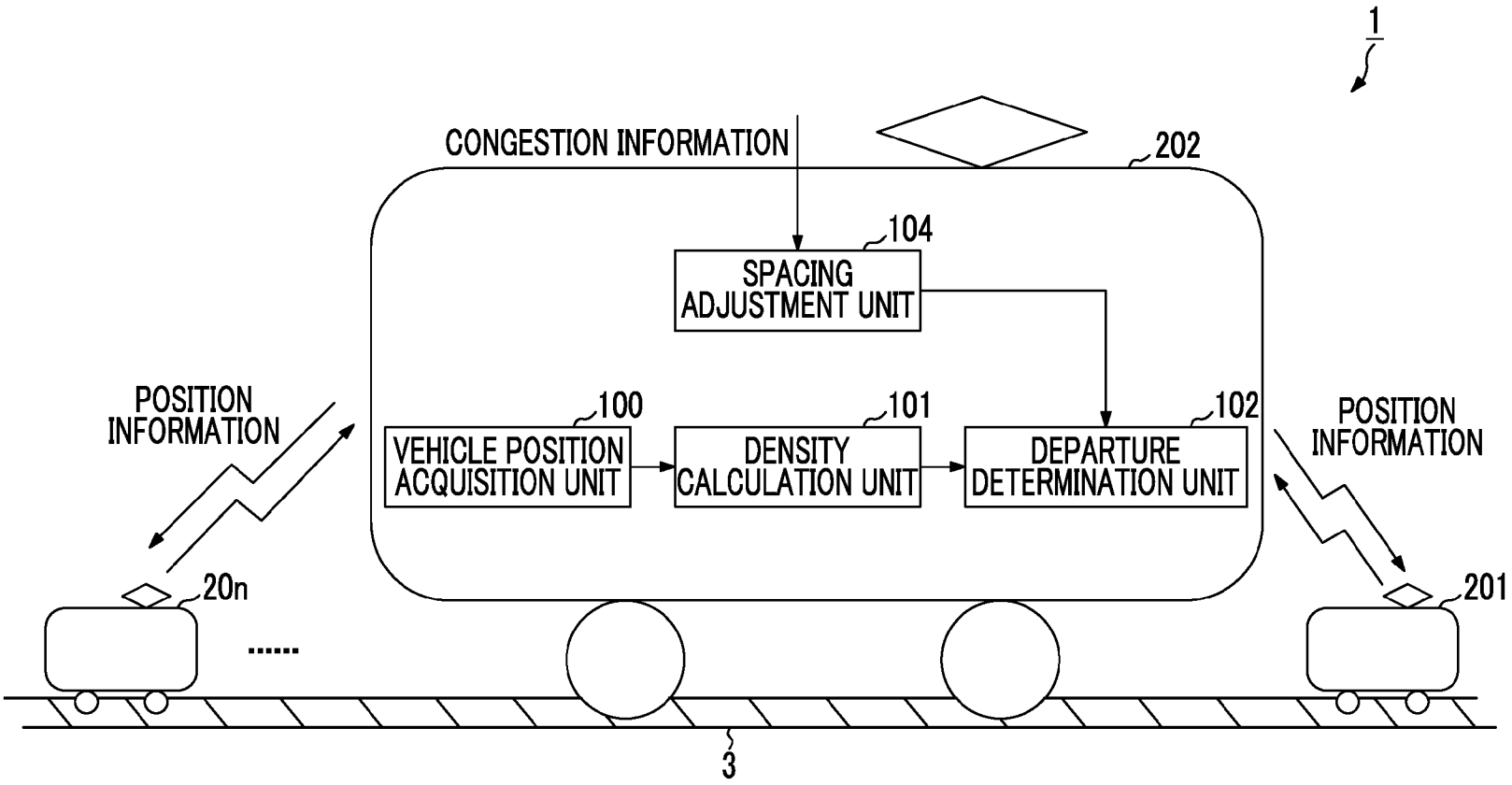
FIG. 18 is a diagram illustrating a functional configuration of a vehicular traffic system according to an eighth embodiment of the present invention.

Further, as illustrated in FIG. 18, the vehicles 201 to 20*n* according to the eighth embodiment of the present invention may include both of the function of the spacing adjustment unit 104 according to the second embodiment and the function of the density calculation unit 101 according to the sixth embodiment described above. Further, in this case, the departure determination unit 102 of the vehicles 201 to 20*n* according to the present embodiment may include both of the function of the departure determination unit 102 according to the second embodiment and the function of the departure determination unit 102 according to the sixth embodiment.

Further, when the vehicles 201 to 20*n* have the functions of both of the second embodiment and the sixth embodiment, if the functions of the density calculation unit 101 and the departure determination unit 102 according to the sixth embodiment are valid, the functions of the spacing adjustment unit 104 and the departure determination unit 102 according to the second embodiment may be invalid. Similarly, when the functions of the spacing adjustment unit 104 and the departure determination unit 102 according to the second embodiment are valid, the functions of the density calculation unit 101 and the departure determination unit 102 according to the sixth embodiment may be invalid. In this way, the respective vehicles 201 to 20*n* can operate while appropriately selecting the function of uniformizing the vehicle spacing according to the sixth embodiment and the function of changing the vehicle density according to the second embodiment.

Figure 19:
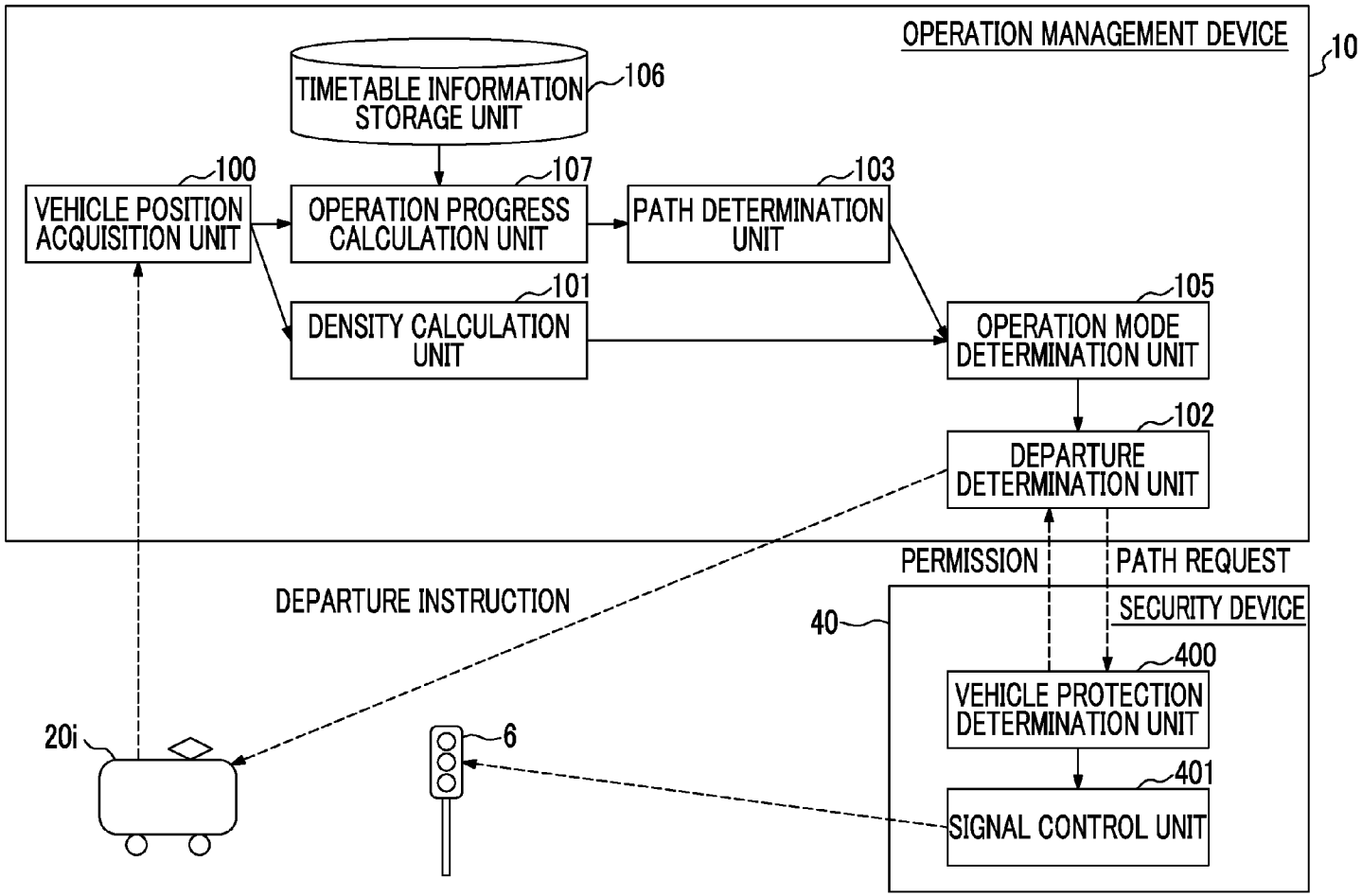
FIG. 19 is a diagram illustrating a functional configuration of a vehicular traffic system according to another embodiment.

FIG. 19 is a diagram illustrating a functional configuration of a vehicular traffic system according to another embodiment.

The operation management device 10 described in each embodiment described above has been described as a functional unit that simply transmits the departure instruction to each of the vehicles 201, 202, . . . , and 20*n* on the basis of the determination of the departure determination unit 102. Also, each of the vehicles 201 to 20*n* has been assumed to operate on the basis of the departure instruction received from the operation management device 10.

However, in an actual operation of the operation management device 10, the operation management device 10 may further include an operation progress calculation unit 107, an operation mode determination unit 105, and a timetable information storage unit 106, as illustrated in FIG. 19.

The operation progress calculation unit 107 is a functional unit that compares the position information of each of the vehicles 201 to 20*n* acquired by the vehicle position acquisition unit 100 with the operation timetable information stored in the timetable information storage unit 106, and calculates progress information indicating progress of an actual operation of each of the vehicles 201 to 20*n*. Further, the earliest departure time determined for each vehicle and each station in advance is recorded in the operation timetable information stored in the timetable information storage unit 106. This earliest departure time is an earliest time at which each vehicle should depart from each station, which is determined on the basis of the operating timetable. The path determination unit 103 can specify the path along which each of the vehicles 201 to 20*n* should then progress at a current time by referring to the progress information calculated by the operation progress calculation unit 107.

The operation mode determination unit 105 is a functional unit that sets an operation mode of each of the vehicles 201 to 20*n* on the basis of the front and rear direction density difference ΔD (or, the front direction density Df and the rear direction density Dr) calculated by the density calculation unit 101. Here, the operation mode determined by the operation mode determination unit 105 includes a "normal operation mode", a "spacing adjustment mode", and an "overcrowding operation mode".

In the normal operation mode, the operation management device 10 performs operation control based on the operation timetable information, as in a conventional case. In this case, after the operation progress calculation unit 107 has determined whether the vehicles 201 to 20*n* can operate according to the timetable of the vehicles 201 to 20*n*, the path determination unit 103 selects a predetermined path for the target vehicle 20*i* according to a result of the determination. Also, the departure determination unit 102 transmits the departure instruction according to the departure time (earliest departure time).

On the other hand, in the spacing adjustment mode, the operation management device 10 performs operation control to adjust the vehicle spacing on the basis of the front direction density Df and the rear direction density Dr described in the third to sixth embodiments.

Further, in the overcrowding operation mode, the operation management device 10 performs operation control to intentionally form the overcrowded state at time T1 and the destination station Hm on the basis of the congestion information described in the first and second embodiments.

For example, when the front and rear direction density difference ΔD is equal to or less than the density difference threshold value α, the operation mode determination unit 105 performs operation control in the normal operation mode (that is, the target vehicle 20*i* departs from each station according to the operation timetable). On the other hand, when the front and rear direction density difference ΔD is greater than the density difference threshold value α, the operation management device 10 proceeds to operation control in the spacing adjustment mode for adjusting the vehicle spacing.

By doing so, when the delay of the operation does not occur, the operation management device 10 can provide an operation service according to the predetermined timetable.

Further, when the departure determination unit 102 proceeds to the operation control of the spacing adjustment mode, the departure time of the target vehicle 20*i* is adjusted on the basis of the front direction density Df and the rear direction density Dr, as described above. In this case, the departure determination unit 102 may adjust the departure time of the target vehicle 20*i* in the spacing adjustment mode not to be a time earlier than an earliest departure time that is a time at which the target vehicle 20*i* should originally depart from the station.

Thus, since the operation management device 10 can prevent the target vehicle 20*i* from departing from the station at a time earlier than an original departure time, the passenger can be prevented from missing the vehicle which the passenger is scheduled to get on.

Further, the operation mode determination unit 105 starts the operation control to immediately switch to the overcrowding operation mode at a timing at which the predetermined congestion information is received to form the overcrowded state.

Further, in the actual operation of the operation management device 10, a process of the security device (interlocking device) 40 and the signal 6 may also be present between the instruction of the operation management device 10 and the operation of each of the vehicles 201 to 20*n*, as illustrated in FIG. 19.

Here, in a general operation management device, all vehicles are tracked and positions thereof are recognized so as to recognize the progress of the operation of each vehicle for a predetermined operation timetable. Also, the operation management device delivers a path request to the security device (also referred to as an interlocking device) on the basis of the progress of the operation of each vehicle for the operation timetable. Here, the security device is an operation control device that performs control of the operation while securing safety of each vehicle. Also, when the security device receives the path request from the operation management device, the security device determines whether the vehicle can depart in terms of safety. Here, when the security device permits the departure, the security device sets the signal corresponding to the path to blue and the vehicle can depart. When this signal remains red, the vehicle continues to stop.

Hereinafter, a process of displaying blue or red in the signal corresponding to the path of the security device 40 is represented as permitting or not permitting the progress to the path.

In this case, before the departure instruction is transmitted to the target vehicle 20*i*, the departure determination unit 102 performs a process of transmitting a path request for the path along which the target vehicle 20*i* should progress, which has been specified by the path determination unit 103, to the security device 40 on the basis of the path information of the track 3, and obtaining a permission of the progress.

Here, the security device 40 includes a vehicle protection determination unit 400, and a signal control unit 401, as illustrated in FIG. 19.

When the vehicle protection determination unit 400 receives the path request for the path along which the target vehicle 20*i* will progress from the operation management device 10, the vehicle protection determination unit 400 determines whether the target vehicle 20*i* is caused to progress along the path in terms of safety. Since the vehicle protection determination unit 400 is a known technology, a specific function thereof is omitted. For example, when another vehicle is present at a progress destination, the vehicle protection determination unit 400 does not permit progress of the target vehicle 20*i*, but permits the progress of the target vehicle 20*i* after the other vehicle disappears from the place.

Further, the path determination unit 103 specifies a path along which the target vehicle 20*i* will progress on the basis of the calculation result of the operation progress calculation unit 107. In this case, when a plurality of path candidates can be selected, the path determination unit 103 may output the path candidates and information indicating a priority determined for each path in advance to the departure determination unit 102. In this case, the departure determination unit 102 may perform a process of transmitting a path request for each path candidate to the security device 40 according to the given priority.

The signal control unit 401 is a functional unit that actually performs control of switching the signal 6 corresponding to the path to blue or red according to permission or non-permission of the progress to the path in response to the path request received by the vehicle protection determination unit 400.

As described above, the operation management device 10 may perform the operation control on the basis of each embodiment described above in a situation in which safety is ensured on the basis of the control of the security device 40. Thus, for example, the departure instruction according to the front direction density Df and the rear direction density Dr that is transmitted by the departure determination unit 102 in the spacing adjustment mode is generated after a condition that safety based on control of the security device 40 is ensured is satisfied. Accordingly, the vehicular traffic system 1 can exhibit each function in each embodiment described above while securing high safety.

Further, the operation management device 10 or the vehicles 201 to 20*n* according to each embodiment described above has a computer system provided therein. Also, each process of the operation management device 10 or the vehicles 201 to 20*n* described above is stored in the form of a program in a computer-readable recording medium, and the computer reads and executes the program to perform the above process. Here, the computer-readable recording medium refers to a magnetic disk, a magneto optical disc, a CD-ROM (Compact Disc Read Only Memory), a semiconductor memory, or the like. Further, this computer program may be distributed to a computer via a communication line, and the computer which has received the distribution may execute the program.

INDUSTRIAL APPLICABILITY

According to the operation management device, the operation management method, the vehicle, the vehicular traffic system, and the program described above, density of provision of a transportation service using the vehicles can be flexibly changed at a desired time and at a desired station.

REFERENCE SIGNS LIST

1 vehicular traffic system
10 operation management device
100 vehicle position acquisition unit
101 density calculation unit
102 departure determination unit
103 path determination unit
104 spacing adjustment unit
105 operation mode determination unit
106 timetable information storage unit
107 operation progress calculation unit
200 to 20*n* vehicle
(3*a*, 3*b*, 3*c*) track

The invention claimed is:

1. An operation management device that manages an operation of a plurality of vehicles traveling along a track, the operation management device comprising:

a vehicle position acquisition unit that acquires positions of the plurality of vehicles present on the track;

a spacing adjustment unit that specifies a reference station that is a reference for increasing frequency of arrival of the plurality of vehicles on the basis of predetermined congestion information indicating information from which occurrence of increasing in passengers at each station can be predicted, and sets a waiting time indicating a stoppage time of the plurality of vehicles at each preceding station of the reference station; and a departure determination unit that adjusts a departure time at the each preceding station, of the plurality of vehicles on the basis of the waiting time, wherein the spacing adjustment unit sets the waiting time at the each preceding station being less than the waiting time of a respective subsequent station of the each preceding station.

2. The operation management device according to claim 1, wherein the spacing adjustment unit sets the waiting time on the basis of the number of passengers which is estimated at the reference station.

3. The operation management device according to claim 1, wherein the spacing adjustment unit sets the waiting time so that a congestion occurrence time estimated on the basis of the congestion information matches a time at which density of the presence of the vehicles increases.

4. The operation management device according to claim 1, wherein the spacing adjustment unit acquires, as the congestion information, one or more of prior passenger attracting information for a scheduled passenger attracting event, detection information acquired from detection means installed in a passage from a passenger attracting place to a station and detecting the number and a flow of passengers who use the passage, and information indicating a scheduled arrival time and a scheduled number of arrival passengers regarding another traffic network.

5. A vehicular traffic system comprising:

the operation management device according to claim 1; and a passenger information system that receives identification information, position information, and path information of a predetermined target vehicle from the operation management device, calculates a scheduled arrival time for each station of the target vehicle, and displays the calculated scheduled arrival, time on a display screen installed in each station.

6. A vehicle that travels along a track, the vehicle comprising:

a vehicle position acquisition unit that acquires a position of the own vehicle on the track;

a spacing adjustment unit that specifies a reference station that is a reference for increasing frequency of arrival of a plurality of vehicles traveling on the track on the basis of predetermined congestion information indicating information from which occurrence of increasing in passengers at each station can be predicted, and sets a waiting time indicating a stoppage time of the plurality of vehicles at each preceding station of the reference station; and a departure determination unit that adjusts a departure time at the each preceding station, of the own vehicle on the basis of the waiting time, wherein the spacing adjustment unit sets the waiting time at the each preceding station being less than the waiting time of a respective subsequent station of the each preceding station.

7. An operation management method for managing an operation of a plurality of vehicles traveling along a track, the operation method comprising steps of:

acquiring positions of the plurality of vehicles present on the track;

specifying a reference station that is a reference for increasing frequency of arrival of the plurality of vehicles on the basis of predetermined congestion information indicating information from which occurrence of increasing in passengers at each station can be predicted, and setting a waiting time indicating a stoppage time of the plurality of vehicles at each preceding station of the reference station; and adjusting a departure time at the each preceding station, of the plurality of vehicles on the basis of the waiting time, wherein in the step of setting the waiting time, setting the waiting time at the each preceding station being less than the waiting time of a respective subsequent station of the each preceding station.

8. A non-transitory computer-readable medium storing program that causes a computer of an operation management device that manages an operation of a plurality of vehicles traveling along a track to function as:

vehicle position acquisition means for acquiring positions of the plurality of vehicles present on the track;

spacing adjustment means for specifying a reference station that is a reference for increasing frequency of arrival of the plurality of vehicles on the basis of predetermined congestion information indicating information from which occurrence of increasing in passengers at each station can be predicted, and setting a waiting time indicating a stoppage time of the plurality of vehicles at each preceding station of the reference station; and departure determination means for adjusting a departure time at the each preceding station, of the plurality of vehicles on the basis of the waiting time, wherein the spacing adjustment means set the waiting time at the each preceding station being less than the waiting time of a respective subsequent station of the each preceding station.

* * * * *